US012066027B2

(12) United States Patent
Lawlor

(10) Patent No.: US 12,066,027 B2
(45) Date of Patent: Aug. 20, 2024

(54) VARIABLE GEOMETRY SUPERSONIC COMPRESSOR

(71) Applicant: NEXT GEN COMPRESSION LLC, Seattle, WA (US)

(72) Inventor: Shawn P. Lawlor, Bellevue, WA (US)

(73) Assignee: NEXT GEN COMPRESSION LLC, Seattle, WA (US)

( * ) Notice: Subject to any disclaimer, the term of this patent is extended or adjusted under 35 U.S.C. 154(b) by 0 days.

(21) Appl. No.: 18/447,852

(22) Filed: Aug. 10, 2023

(65) Prior Publication Data

US 2024/0229804 A1 Jul. 11, 2024

Related U.S. Application Data

(60) Provisional application No. 63/397,312, filed on Aug. 11, 2022.

(51) Int. Cl.
*F04D 17/12* (2006.01)
*F04D 21/00* (2006.01)
(Continued)

(52) U.S. Cl.
CPC ..... *F04D 17/127* (2013.01); *F04D 21/00* (2013.01); *F04D 27/004* (2013.01); *F04D 29/056* (2013.01); *F04D 29/286* (2013.01)

(58) Field of Classification Search
CPC ..... F04D 21/00
See application file for complete search history.

(56) References Cited

U.S. PATENT DOCUMENTS 1,883,868 A 10/1932 Beckman
2,435,236 A 2/1948 Redding
(Continued)

FOREIGN PATENT DOCUMENTS

CN 106988882 A 7/2017
CN 206874366 U 1/2018
(Continued)

OTHER PUBLICATIONS

10155771_11351191A (Pub Date: Dec. 21, 1999) Patent Abstracts of Japan—High Pressure Generating Method and Compressor Using This Method.
(Continued)

*Primary Examiner* — Brian O Peters
(74) *Attorney, Agent, or Firm* — R. Reams Goodloe, Jr.

(57) ABSTRACT

A counter-rotating supersonic compressor. A first subsonic rotor includes a plurality of unshrouded impulse rotor blades operating at sub-sonic conditions. A second, supersonic rotor includes a fixed second rotor portion and an adjustable second rotor portion. The fixed second rotor portion includes a plurality of supersonic passageways having converging-diverging sidewalls, and internal boundary layer bleed passageways. The adjustable second rotor portion includes a plurality of centerbodies which are disposed in the supersonic passageways. Helical movement (circumferential and axial) movement of the adjustable second rotor portion with respect to the fixed second rotor portion enables upstream and downstream movement of the centerbodies in the supersonic passageways. This movement facilitates ease of supersonic startup, and automatic adjustment for changes in operation conditions, such as pressure, temperature, or mass flow rate of a working fluid such as carbon dioxide.

46 Claims, 19 Drawing Sheets

(51) Int. Cl.

| | |
|---|---|
| ***F04D 27/00*** | (2006.01) |
| ***F04D 29/056*** | (2006.01) |
| ***F04D 29/28*** | (2006.01) |

(56) References Cited

U.S. PATENT DOCUMENTS

| | | | | |
|---|---|---|---|---|
| 2,570,081 | A | | 10/1951 | Szczeniowski |
| 2,579,049 | A | | 12/1951 | Price |
| 2,623,688 | A | | 12/1952 | Davidson |
| 2,628,768 | A | | 2/1953 | Kantrowitz |
| 2,648,493 | A | * | 8/1953 | Stalker ..... F04D 21/00 415/181 |
| 2,659,528 | A | | 11/1953 | Price |
| 2,674,845 | A | | 4/1954 | Pouchot |
| 2,689,681 | A | | 9/1954 | Sabatiuk |
| 2,710,136 | A | | 6/1955 | De Ganahl et al. |
| 2,721,693 | A | | 10/1955 | Fabri et al. |
| 2,749,027 | A | | 6/1956 | Stalker |
| 2,763,426 | A | | 9/1956 | Erwin |
| 2,780,436 | A | | 2/1957 | Holzwarth |
| 2,792,983 | A | | 5/1957 | Stalker |
| 2,797,858 | A | | 7/1957 | Von Der Nuell |
| 2,805,818 | A | | 9/1957 | Ferri |
| 2,806,645 | A | | 9/1957 | Stalker |
| 2,819,837 | A | | 1/1958 | Loeb |
| 2,830,753 | A | | 4/1958 | Stalker |
| 2,834,573 | A | | 5/1958 | Stalker |
| 2,839,239 | A | | 6/1958 | Stalker |
| 2,841,325 | A | | 7/1958 | Weise |
| 2,853,227 | A | | 9/1958 | Beardsley |
| 2,853,852 | A | | 9/1958 | Bodine |
| 2,918,254 | A | | 12/1959 | Hausammann |
| 2,934,259 | A | | 4/1960 | Hausmann |
| 2,935,246 | A | | 5/1960 | Roy |
| 2,943,839 | A | | 7/1960 | Birmann |
| 2,944,786 | A | | 7/1960 | Angell et al. |
| 2,947,139 | A | | 8/1960 | Hausmann |
| 2,949,224 | A | | 8/1960 | Pavlecka |
| 2,953,295 | A | | 9/1960 | Stalker |
| 2,955,747 | A | | 10/1960 | Schwaar |
| 2,956,732 | A | | 10/1960 | Stalker |
| 2,966,028 | A | | 12/1960 | Johnson et al. |
| 2,967,013 | A | | 1/1961 | Dallenbach et al. |
| 2,970,750 | A | | 2/1961 | Swearingen |
| 2,971,329 | A | | 2/1961 | Barry |
| 2,971,330 | A | | 2/1961 | Clark |
| 2,974,857 | A | | 3/1961 | Schwaar |
| 2,974,858 | A | | 3/1961 | Koffel et al. |
| 2,974,927 | A | | 3/1961 | Johnson |
| 2,989,843 | A | | 6/1961 | Ferri |
| 2,991,929 | A | | 7/1961 | Stalker |
| 3,001,364 | A | | 9/1961 | Woodworth |
| 3,010,642 | A | | 11/1961 | Dickmann et al. |
| 3,054,255 | A | | 9/1962 | Stratford |
| 3,062,484 | A | | 11/1962 | Himka |
| 3,088,279 | A | | 5/1963 | Diedrich |
| 3,118,277 | A | | 1/1964 | Wormser |
| 3,145,915 | A | | 8/1964 | Marchal et al. |
| 3,156,407 | A | | 11/1964 | Bourquard |
| 3,184,152 | A | | 5/1965 | Bourquard |
| 3,265,331 | A | | 8/1966 | Miles |
| 3,269,120 | A | | 8/1966 | Sabatiuk |
| 3,356,289 | A | | 12/1967 | Plotkowiak |
| 3,422,625 | A | | 1/1969 | Harris |
| 3,442,441 | A | | 5/1969 | Dettmering |
| 3,447,325 | A | | 6/1969 | Tiley |
| 3,447,740 | A | | 6/1969 | Fabri et al. |
| 3,524,458 | A | | 8/1970 | Goldsmith |
| 3,541,790 | A | | 11/1970 | Kellett |
| 3,588,270 | A | | 6/1971 | Boelcs |
| 3,643,676 | A | | 1/1972 | Limage et al. |
| 3,658,437 | A | | 4/1972 | Soo |
| 3,692,425 | A | | 9/1972 | Erwin |
| 3,719,426 | A | | 3/1973 | Friberg |
| 3,719,428 | A | | 3/1973 | Dettmering |
| 3,724,968 | A | | 4/1973 | Friberg et al. |
| 3,765,792 | A | | 10/1973 | Exley |
| 3,771,925 | A | | 11/1973 | Friberg et al. |
| 3,777,487 | A | | 12/1973 | Norman et al. |
| 3,783,616 | A | | 1/1974 | Norman et al. |
| 3,797,239 | A | | 3/1974 | Hausmann et al. |
| 3,824,029 | A | | 7/1974 | Fabri et al. |
| 3,846,039 | A | | 11/1974 | Stalker |
| 3,873,229 | A | | 3/1975 | Mikolajczak et al. |
| 3,904,308 | A | | 9/1975 | Ribaud |
| 3,904,312 | A | | 9/1975 | Exley |
| 3,917,434 | A | | 11/1975 | Bandukwalla |
| 3,956,887 | A | | 5/1976 | MacDonald |
| 3,971,209 | A | | 7/1976 | de Chair |
| 3,989,406 | A | | 11/1976 | Bliss |
| 3,993,414 | A | | 11/1976 | Meauze et al. |
| 4,000,869 | A | | 1/1977 | Wong et al. |
| RE29,128 | E | | 2/1977 | Sohre |
| 4,006,997 | A | | 2/1977 | Friberg et al. |
| 4,007,891 | A | | 2/1977 | Sorensen et al. |
| 4,011,028 | A | | 3/1977 | Borsuk |
| 4,012,165 | A | | 3/1977 | Kraig |
| 4,012,166 | A | | 3/1977 | Kaesser et al. |
| 4,070,824 | A | | 1/1978 | Traut |
| 4,088,270 | A | | 5/1978 | Maiden |
| 4,123,196 | A | | 10/1978 | Prince, Jr. et al. |
| 4,156,344 | A | | 5/1979 | Cuthbertson et al. |
| 4,199,296 | A | | 4/1980 | De Chair |
| 4,212,585 | A | | 7/1980 | Swarden et al. |
| 4,241,576 | A | | 12/1980 | Gertz |
| RE30,720 | E | | 8/1981 | Sohre |
| 4,408,957 | A | | 10/1983 | Kurzrock et al. |
| 4,445,816 | A | | 5/1984 | Ribaud et al. |
| 4,477,039 | A | | 10/1984 | Boulton et al. |
| 4,479,755 | A | | 10/1984 | Skoe |
| 4,607,657 | A | | 8/1986 | Hirschkron |
| 4,620,679 | A | | 11/1986 | Karanian |
| 4,621,978 | A | | 11/1986 | Stuart |
| 4,678,398 | A | | 7/1987 | Dodge et al. |
| 4,707,978 | A | | 11/1987 | Garcia Cascajosa |
| 4,741,497 | A | | 5/1988 | Fox |
| 4,872,807 | A | | 10/1989 | Thompson |
| 4,879,895 | A | | 11/1989 | Sajben |
| 4,909,031 | A | | 3/1990 | Grieb |
| 5,074,118 | A | | 12/1991 | Kepler |
| 5,101,615 | A | | 4/1992 | Herzog |
| 5,123,811 | A | | 6/1992 | Kuroiwa |
| 5,161,845 | A | | 11/1992 | Clevenger et al. |
| 5,186,390 | A | | 2/1993 | Enderle et al. |
| 5,277,549 | A | | 1/1994 | Chen et al. |
| 5,286,162 | A | | 2/1994 | Veres |
| 5,341,636 | A | | 8/1994 | Paul |
| 5,351,480 | A | | 10/1994 | Kretschmer |
| 5,445,496 | A | | 8/1995 | Brasz |
| 5,554,000 | A | | 9/1996 | Katoh et al. |
| 5,676,522 | A | | 10/1997 | Pommel et al. |
| 5,704,764 | A | | 1/1998 | Chupp et al. |
| 5,709,076 | A | | 1/1998 | Lawlor |
| 5,782,079 | A | | 7/1998 | Chiang et al. |
| 5,904,470 | A | | 5/1999 | Kerrebrock et al. |
| 6,009,406 | A | | 12/1999 | Nick |
| 6,017,186 | A | | 1/2000 | Hoeger et al. |
| 6,263,660 | B1 | | 7/2001 | Lawlor |
| 6,279,309 | B1 | | 8/2001 | Lawlor et al. |
| 6,280,139 | B1 | | 8/2001 | Romani et al. |
| 6,298,653 | B1 | | 10/2001 | Lawlor et al. |
| 6,334,299 | B1 | | 1/2002 | Lawlor |
| 6,358,012 | B1 | | 3/2002 | Staubach |
| 6,434,924 | B1 | | 8/2002 | Lawlor |
| 6,446,425 | B1 | | 9/2002 | Lawlor |
| 6,488,469 | B1 | | 12/2002 | Youssef et al. |
| 6,507,125 | B1 | | 1/2003 | Choi |
| RE38,040 | E | | 3/2003 | Spear et al. |
| 6,682,301 | B2 | | 1/2004 | Kuhne |
| 6,694,743 | B2 | | 2/2004 | Lawlor et al. |
| 6,920,892 | B2 | | 7/2005 | Sanders et al. |
| 7,147,426 | B2 | | 12/2006 | Leblanc et al. |
| 7,252,263 | B1 | | 8/2007 | Hagemeister |
| 7,293,955 | B2 | | 11/2007 | Lawlor et al. |

(56) References Cited

U.S. PATENT DOCUMENTS

| | | | |
|---|---|---|---|
| 7,334,990 | B2 | 2/2008 | Lawlor et al. |
| 7,337,606 | B2 | 3/2008 | Brouillette et al. |
| 7,434,400 | B2 | 10/2008 | Lawlor et al. |
| 7,594,403 | B2 | 9/2009 | Cadieux |
| 7,685,824 | B2 | 3/2010 | Dahm |
| 8,021,106 | B2 | 9/2011 | Battig |
| 8,152,439 | B2 | 4/2012 | Lawlor |
| 8,162,604 | B2 | 4/2012 | Kuhnel et al. |
| 8,359,825 | B2 | 1/2013 | Alvi |
| 8,371,324 | B1 | 2/2013 | Fink |
| 8,500,391 | B1 | 8/2013 | Lawlor |
| 8,770,929 | B2 | 7/2014 | Hofer |
| 9,279,334 | B2 | 3/2016 | Lawlor |
| 9,954,416 | B2 | 4/2018 | Kataoka et al. |
| 10,962,016 | B2 | 3/2021 | Brasz et al. |
| 11,585,347 | B2 | 2/2023 | Joly et al. |
| 11,592,034 | B2 | 2/2023 | Halbe et al. |
| 2002/0073714 | A1 | 6/2002 | Yim et al. |
| 2003/0014960 | A1 | 1/2003 | Lawlor |
| 2003/0210980 | A1 | 11/2003 | Lawlor |
| 2004/0020185 | A1 | 2/2004 | Brouillette et al. |
| 2004/0154305 | A1 | 8/2004 | Lawlor et al. |
| 2005/0249578 | A1 | 11/2005 | Leblanc et al. |
| 2005/0271500 | A1 | 12/2005 | Lawlor et al. |
| 2006/0021353 | A1 | 2/2006 | Lawlor et al. |
| 2006/0034691 | A1 | 2/2006 | Lawlor et al. |
| 2006/0218921 | A1 | 10/2006 | Sumser |
| 2007/0056291 | A1 | 3/2007 | Dahm |
| 2007/0274826 | A1 | 11/2007 | Kuhnel et al. |
| 2009/0123302 | A1 | 5/2009 | Nishimura et al. |
| 2009/0196731 | A1 | 8/2009 | Lawlor |
| 2009/0211221 | A1 | 8/2009 | Roberge |
| 2009/0288711 | A1 | 11/2009 | Alvi |
| 2010/0158665 | A1 | 6/2010 | Hofer |
| 2011/0296841 | A1 | 12/2011 | Napier |
| 2012/0156015 | A1 | 6/2012 | Devi et al. |
| 2013/0037657 | A1 | 2/2013 | Breidenthal |
| 2013/0039748 | A1 | 2/2013 | Lawlor |
| 2013/0142632 | A1 | 6/2013 | Roberts, II et al. |
| 2013/0149100 | A1 | 6/2013 | Lawlor |
| 2013/0154121 | A1 | 6/2013 | Roberts, II et al. |
| 2013/0164120 | A1 | 6/2013 | Saretto et al. |
| 2013/0223975 | A1 | 8/2013 | Lawlor |
| 2015/0015104 | A1 | 1/2015 | Kataoka et al. |
| 2016/0281736 | A1 | 9/2016 | Wiederien et al. |
| 2017/0204878 | A1 | 7/2017 | Orosa |
| 2017/0350417 | A1 | 12/2017 | Maier |
| 2018/0066671 | A1 | 3/2018 | Murugan et al. |
| 2019/0101012 | A1 | 4/2019 | Kolvick et al. |
| 2022/0049716 | A1 | 2/2022 | Halbe et al. |
| 2022/0135414 | A1 | 5/2022 | Ahmad et al. |
| 2022/0233993 | A1 | 7/2022 | Rosinski et al. |

FOREIGN PATENT DOCUMENTS

| | | | |
|---|---|---|---|
| CN | 107989804 | A | 5/2018 |
| CN | 110500299 | B | 4/2021 |
| EP | 0375198 | A2 | 6/1990 |
| EP | 1741935 | A1 | 1/2007 |
| EP | 3702584 | A1 | 9/2020 |
| FR | 863484 | | 1/1941 |
| GB | 648647 | | 1/1951 |
| GB | 857800 | | 1/1961 |
| GB | 1468584 | | 3/1977 |
| JP | 11-351191 | | 12/1999 |
| JP | 2001-295775 | | 10/2001 |
| WO | WO 2016001476 | A1 | 1/2016 |
| WO | WO 2019/160550 | A1 | 8/2019 |

OTHER PUBLICATIONS

2001104506_2001295775A (Pub Date: Oct. 26, 2001) Patent Abstracts of Japan—High Pressure Compressor.

Naca Research Memorandum, Performance of an Impulse-Type Supersonic Compressor With Stators, John F. Klapproth. National Advisory Committee for Aeronautics, Washington, Apr. 28, 1952 (23 pages) with 1 page NASA Technical Reports Server (NTRS).

Inlet Unstart Boundaries AFT Bypass Closed, SR-71 Flight Manual (Undated) 1pg.

Engine Stall Regions—Supersonic SR-71 Flight Manual (undated) 1pg.

PCT International Search Report issued Dec. 4, 2023, Written Opinion of the International Searching Authority (KIPO) issued Dec. 4, 2023. PCT/US2023/030015. (8pgs).

* cited by examiner

Mass Spilled from Inlet, Normal Shock Stabilized at Capture Plane with $M_t<1$

Mass Spilled Eliminated, Shock Swallowed, Inlet 'Started'

VARIABLE GEOMETRY SUPERSONIC COMPRESSOR

RELATED PATENT APPLICATIONS

This application claims priority from prior U.S. Provisional Patent Application Ser. No. 63/397,312, filed Aug. 11, 2022, entitled VARIABLE GEOMETRY SUPERSONIC COMPRESSOR, the disclosure of which is incorporated herein in its entirety, including the specification, drawing, and claims, by this reference.

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This disclosure relates to gas compressors, and more specifically to supersonic compressors.

BACKGROUND

A continuing interest and need exists for improvements in gas compressors. In one currently important application, a need exists for improved compressors for the compression of carbon dioxide. It would be especially advantageous if a design with significant improvement in efficiency were made available, so that operational costs of carbon capture projects utilizing carbon dioxide gas compression could be reduced.

In general, compression of gasses in radial flow compressors or in axial flow compressors is based on the exchange of kinetic energy of the gas to be compressed to potential energy represented by pressure attained in the compressor. In the case of an axial flow compressor, kinetic energy is typically imparted to the gas with rotating components including rotor blades. Then this kinetic energy is converted to potential energy in the form of pressure, usually by use of a downstream stationary component, typically referred to as a stator blade. The greater the speed of the rotor, the more kinetic energy is imparted and, in general, the greater the pressure ratio achieved by a rotor-stator pair. In the case of a radial compressor, kinetic energy is imparted to the working fluid at the leading edge of the vanes of the inducer and then a combination of inducer rotating speed and increasing radius with attendant centripetal forces, results in an increase in the pressure of the working fluid.

It is well known that aerodynamic losses increase as the speed of the rotating element (rotor in the case of an axial compression stage or inducer in the case of a radial compressor) increases. It is the speed of the rotating component which is responsible for imparting the kinetic energy to the working fluid and therefore determinant of the pressure ratio of the stage (kinetic energy is converted into potential energy in the form of pressure increase in the working fluid). Thus, the greater the speed of the rotor, the greater the kinetic energy imparted to the working fluid and the greater the possible pressure ratio of the stage. But because of the increase in aerodynamic losses attendant with increasing rotor speed, there is a tradeoff between the available pressure ratio that a single rotor/stator pair can deliver, and the efficiency of the compressor.

A rotor-stator pair (in the case of an axial flow compressor), or a single radial inducer (in the case of a radial flow compressor), may be referred to as a compression stage. Many industrial compression applications, as well as aerospace compression applications, may require multiple compressor stages in order to achieve an overall compressor pressure ratio design objective. Thus, a key factor in the design of any compressor is the determination of the number of compressor stages that will be required to achieve the compressor pressure ratio design objective. Overall capacity, as well as cost considerations, favors minimizing the number of compressor stages. And, increasing the pressure ratio in various stages becomes problematic with regard to compressor efficiency. Thus, the above mentioned tradeoff between capital cost and operating cost (i.e. compressor efficiency) is always under scrutiny. Because of the consumption of power required to drive compressors, and the cost of supplying that power, compressor efficiency is often the dominant factor under consideration during design. For compressor systems that require overall pressure ratios ("PR") of about three (3), and certainly if over about five (5), prior art compressor designs are usually configured to employ multiple stages. Such design considerations become more acute in compression of higher molecular weight gases, such as those set out in Table 1. Table 1 additionally shows the speed of sound "a" in such gases.

One aerodynamic parameter considered during compressor design is the velocity of a leading edge of a rotor or inducer with respect to the working fluid. When the rotor or inducer velocity in the working fluid exceeds about zero point eight five Mach (M>0.85), aerodynamic shock waves begin to develop on the surfaces of the blade or vane, at a location downstream of the leading edge. Such shock waves may produce unacceptable levels of aerodynamic loss. Consequently, in most prior art compressor designs, the design velocity of the rotating blades are configured so that the relative Mach number of the blade (or vane) leading edges remain below about zero point eight five Mach (M<0.85). Such prior art designs are usually referred to as a subsonic or in some cases transonic blade design.

TABLE 1

| Gas | Mol Wt (lb/lb mol) | R (ft-lbf/lbm-R) | Gamma (—) | a (ft/s) |
|---|---|---|---|---|
| Air | 29.0 | 1,714.9 | 1.40 | 1,117 |
| Argon | 39.9 | 1,283.7 | 1.67 | 1,056 |
| N-Butane | 58.1 | 852.6 | 1.67 | 860 |
| Butene-1 | 56.1 | 884.8 | 1.11 | 715 |
| Carbon Dioxide | 44.0 | 1,129.3 | 1.30 | 874 |
| Chlorine | 70.9 | 701.4 | 1.33 | 696 |
| Ethyl Chloride | 64.5 | 772.2 | 1.13 | 674 |
| Freon (F-12) | 120.9 | 405.4 | 1.13 | 488 |
| Pentane | 72.1 | 21.3 | 1.06 | 108 |
| Sulphur Dioxide | 64.1 | 24.0 | 1.26 | 125 |

It is known that there is considerable potential savings, or increases in compressor efficiency, by increasing the relative Mach number of the blade leading edges into the supersonic range, where the Mach number is greater than one (M>1), which would allow the use of designs with fewer stages.

Unfortunately in existing prior art compressor designs which have attempted operation at such Mach numbers, the aerodynamic losses are unacceptably high, and such loses outweigh the advantages provided by use of a decreased number of stages.

There have been various theoretical designs suggested, and experimental designs attempted, to address these and related problems, but to date, it appears that none of the designs suggested or attempted have enabled implementation of a compressor design that enables the compressor to take advantage of fully supersonic internal flow without suffering from unacceptable levels of aerodynamic loss. Moreover, most prior art supersonic compressor designs that have suffered from difficulty in "starting" a supersonic flow within the rotor blades. Such a "start" process is sometimes referred to as shock swallowing, which is a process by which an internal shockwave is developed, and then transits through a minimum area throat, to reach and become stabilized at a suitable location for highly efficient supersonic compression, at a design supersonic operating condition.

Additionally, the theoretical designs suggested, and experimental designs attempted for supersonic compressors have had only a limited "turndown" ability, in that they are unable to appreciably vary mass flow while maintaining output pressure or while minimizing the loss of efficiency. Unfortunately, it is often the case in the design of industrial compressors for process gas applications that the mass flow of working fluid will vary with time for any given application. Thus, in order for a supersonic compressor design to qualify for use in various applications, or even in application of a single gas which may vary in quantity, and/or pressure, and/or temperature, a desirable compressor design should be capable of accommodating a design variation in mass flow (for many applications, a part load mass throughput of about sixty to seventy percent (60%-70%) of full load capacity, would be desirable. And, it would be desirable to maintain discharge pressure under such turndown conditions with a minimal decrease in compression process overall efficiency.

Additionally, while there have been many attempts by others to provide improved supersonic gas compressors, most versions of which I am aware have fallen flat when it came to operability and reliability. At best, currently available gas compressor designs are primarily useful within the confines of a constant temperature and pressure gas input, since off-design conditions results in supersonic shock locations at positions which don't enable optimum efficiency, or in worst case situations, result in the inability to provide adequate starting capability, or control of boundary layer effects during operation. Consequently, there remains a need for an improved supersonic compressor design which provides easy operational adjustment for startup, and for optimization of efficiency during operation. Such a design would improve compressor flexibility with regard to varying input conditions, and increase reliability while reducing operating costs to the user.

Thus, it would be desirable if a supersonic compressor was available that included design components which made operational adjustments for starting and for efficient operation feasible within high speed rotating equipment. Such improved features would facilitate simple adjustments to accommodate changes in working fluid composition, pressure, and temperature, and thus would be advantageous in maintaining efficient supersonic compressor operation.

Technical Problem to be Solved

In prior art supersonic compressor designs, the flow path provided on a rotors have generally provided a stationary shock generating structure, and in some cases, have additionally provided a boundary layer bleed system. However, in actual practice, the location of a normal shock in a selected working fluid resulting from such fixed structures may vary depending on the density, as affected by the pressure, and temperature of the working fluid. Thus, fixed geometry for structures encountering supersonic gas flow in rotating compressor components presents the problems of (a) difficulty (or inability) to start a supersonic compressor component, and (b) inefficiency in operation, when shocks generated in the supersonic compressor components are not located to take maximum advantage of the generation of a supersonic shockwave.

Thus, the technical problem to be solved is how to provide a design for a rotor in which adjustment of shock generating structures in supersonic compression passageways is provided, to facilitate startup of the supersonic compressor, and to enable optimization of shock location, for maximizing efficiency, while the rotor is operating at high speed.

The invention(s) disclosed herein are provided to solve the above mentioned problems.

Some Objects, Advantages, and Novel Features

Accordingly, one objective of my invention is to provide a supersonic compressor design which is simple, straightforward, and in which an adjustably locatable shock generating body is provided in the supersonic compression passageways of rotating components in a compressor.

Another objective of my invention is to provide a design for an adjustably locatable shock generating body in the supersonic compression passageways, where the shock generating body can be adjusted to any one of multiple locations along a helical arc length L, so that the shock generating body position may be adjusted to facilitate (a) swallowing an initial shock and assuring supersonic operation startup of the compressor, or (b) efficient ongoing operation of the compressor, or (c) meets changing operational requirements, such as change in mass flow rate, or pressure, and/or temperature of a working fluid.

A related and important objective is to provide operational controls in a compressor system, which advantageously utilizes adjustments in the adjustably locatable shock generating body in the supersonic compression passageways, so that increased rotational speed may be utilized to maintain a desired output pressure, while minimizing loss in efficiency, during turndown of mass flow rates as low as the range of sixty to seventy percent (60%-70%) of rated design capacity of the compressor system.

Summary of Design for Solving the Problem

A supersonic gas compressor is provided with an adjustably locatable shock generating body in supersonic compression passageways. In an embodiment, the gas compressor includes (a) a pressure case having a peripheral wall, (b) an inlet for supply of gas and an outlet for compressed gas, (c) a first drive shaft extending along a first central axis, (d) a first rotor, and (e) a second rotor. The first rotor is driven by the first drive shaft for rotary motion in a first direction within the pressure case. In an embodiment, the first rotor includes a plurality of impulse blades. In an embodiment, the impulse blades are unshrouded. The second rotor is driven by the first drive shaft for rotary motion in a second direction within the pressure case. The second direction is opposite in rotation from the first direction, so that the compressor is configured for counter-rotating operation. In an embodiment, the second rotor includes (1) a fixed second rotor portion having a plurality of converging-diverging passageways configured for supersonic compression of gas. The passageways have an inlet with an initial shock wave generating surface, a throat portion, and an exit. The passageways have a longitudinal axis, wherein the longitudinal axis is offset toward the first rotor by an angle of attack alpha ($\alpha$). The second rotor also includes an adjustable second rotor portion. There is a geared interface between the fixed second rotor portion and the adjustable second rotor portion. The adjustable second rotor portion includes a shockwave generating body extending outward from the adjustable second rotor portion into each of the passageways in the fixed second rotor portion. The throat portion has a variable cross-sectional area, as facilitated by the adjustably positionable shockwave generating body extending from the adjustable second rotor portion. In an embodiment, the adjustable second rotor portion may include an annular outer edge, and each shockwave generating body may be affixed to the annular outer edge.

In an embodiment, each shockwave generating body may be translatable via the geared interface to provide simultaneous axial and circumferential motion of the shockwave generating body relative to the first drive shaft. Such movement of each shockwave generating body provides movement of each body in a direction parallel to or along a longitudinal axis of the passageway in which it is located. In an embodiment, the shockwave generating body may be provided in a generally diamond shaped configuration, and thus the upstream or downstream movement of the shockwave generating body provides an increase or decrease in the cross-sectional area of the throat portion of the passageway. In an embodiment, the shockwave generating body may be a centerbody. In an embodiment, the shockwave generating body may be a diamond shaped centerbody.

The increase or decrease in the cross-sectional area of the throat portion, provided by the movement of the shockwave generating body, enables both ease of startup, and efficient supersonic gas compression operation of the converging-diverging passageways, especially under changing conditions, as facilitated by the adjustment of the position of the shockwave generating body therein.

In an embodiment, the passageways include a radially inward floor at radius R from the first central axis. In an embodiment, the adjustable second rotor portion is adjustable with respect to the fixed second rotor portion to locations having a position within by a circumferential angle theta ($\theta$), so that the shockwave generating body is translatable for an arc distance of length L. In an embodiment, the adjustable second rotor portion is configured for axial movement away from the fixed second rotor portion by an axial distance X. Thus, in various embodiments, the shock generating body in each passageway may be translatable upstream or downstream along a flowpath centerline of the passageway in which it is located. In various embodiments, the shock generating body in each passageway may be translatable upstream or downstream along a helical path relative to the first central axis.

In various embodiments, one or more of the passageways may further comprise a peripheral shroud. In an embodiment, each of the passageways may further comprise a peripheral shroud. In an embodiment, the peripheral shroud may be provided in the form of a thin cylindrical annular ring, in which the cylindrical annular ring peripherally encompasses all of the passageways on the second rotor.

BRIEF DESCRIPTION OF THE DRAWING

The present invention(s) will be described by way of exemplary embodiments, using for illustration the accompanying drawing in which like reference numerals denote like elements, and in which:

FIG. 5 shows the position of the adjustable second rotor portion with respect to a fixed first rotor portion, when the adjustable second rotor portion has not yet been turned circumferentially (i.e. to move the shockwave generating centerbodies to the maximum downstream position) and where the adjustable second rotor portion has not been adjusted axially away from the fixed second rotor portion.

FIG. 6 shows an embodiment for the position of the adjustable second rotor portion with respect to a fixed first rotor portion, when the adjustable second rotor portion has been turned circumferentially (i.e. to locate the shockwave generating bodies at a maximum upstream position) and where the adjustable second rotor portion has been simultaneously adjusted axially to a maximum distance away from the fixed second rotor portion.

FIG. 12 illustrates an advantageous location for a shockwave generating body during startup of the supersonic compressor (showing half of a passageway and assuming use of symmetrical passageways), illustrating an exemplary downstream location that allows for an expanded throat area of the passageway, which is advantageous for startup of the compressor.

FIG. 13 illustrates an advantageous location for a shockwave generating body during normal full load operation of the supersonic compressor (showing half of a passageway and assuming use of symmetrical passageways), illustrating an exemplary upstream location that allows for a narrowed throat area of the passageway, which is advantageous for locating the normal shock in order to optimize the benefits of supersonic compressor operation.

FIG. 14 illustrates an advantageous location for the centerbody during operation with significant turndown (e.g. in the 60% to 70% range of rated design capacity) using the supersonic compressor, illustrating half of a passageway (and assuming use of symmetrical passageways) to show repositioning of a centerbody.

Figure 1:
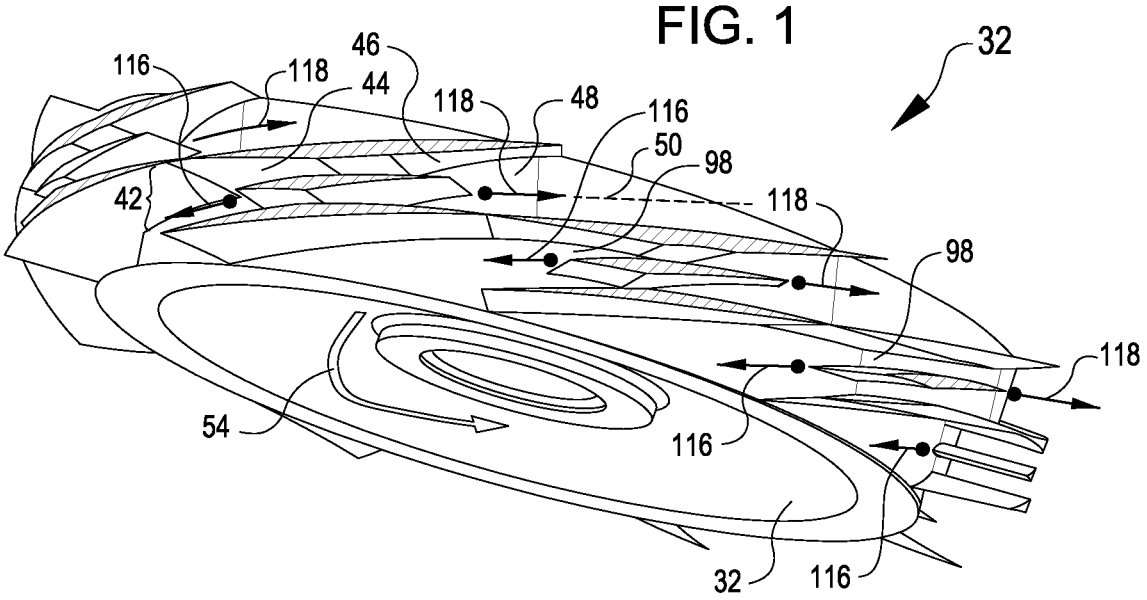
FIG. 1 is a perspective view of an embodiment for a rotor which includes a plurality of converging-diverging passageways for supersonic gas compression, and shows use of generally diamond shaped center-bodies in each of the passageways which may, in an embodiment, be adjusted upstream or downstream along a helical arc of length L (see FIG. 4) to allow adjustment for starting, or for efficient operation as operational requirements change; note that the peripheral shroud, shown in FIG. 2 below, has been removed for illustrative purposes in this FIG. 1.

The foregoing figures, being merely exemplary, contain various elements that may be present or omitted from a final configuration for a supersonic gas compressor. Other variations in the construction of an exemplary supersonic compressor may use different materials of construction, varying mechanical structures, mechanical arrangements, gas flow configurations, or adjustment mechanism configurations, or gear drive configurations, and yet employ the basic adjustment principles described and claimed herein, and as generally depicted in the drawing figures provided. An attempt has been made to draw the figures in a way that illustrates at least those elements that are significant for an understanding of exemplary supersonic compressor designs. Such details may be quite useful for providing a novel supersonic compressor system for use in various gas compression applications. Thus, it should be understood that various features may be utilized in accord with the teachings hereof, as may be useful in different supersonic compressor rotor embodiments for use with a supersonic compressor for various capacity and working fluids, depending upon specific design requirements, within the scope and coverage of the teachings herein as defined by the claims.

DETAILED DESCRIPTION

Figure 2:
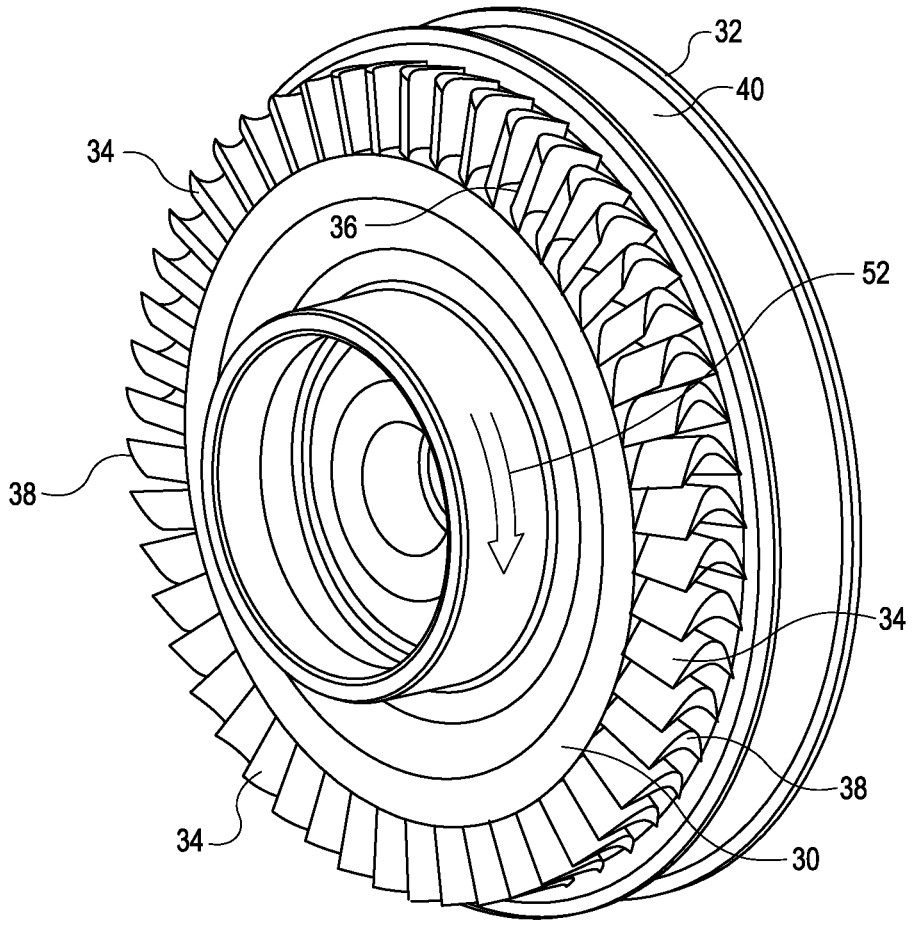
FIG. 2 is a perspective view of counter-rotating rotors used in an embodiment for a compression stage, wherein a first rotor uses a plurality of unshrouded impulse blades for subsonic acceleration of a working fluid, and wherein a second rotor (now showing use of a peripheral shroud) of the type just illustrated in FIG. 1 above is provided.

Attention is directed to FIG. 2, where counter-rotating first rotor 30 and second rotor 32 are provided for an embodiment of a compressor configured for supersonic operation, as further discussed herein. The first rotor 30 includes blades 34, extending outward along an outer surface portion 36 to a tip end 38. In an embodiment, the blades 34 may be provided in the form of impulse blades.

Figure 3:
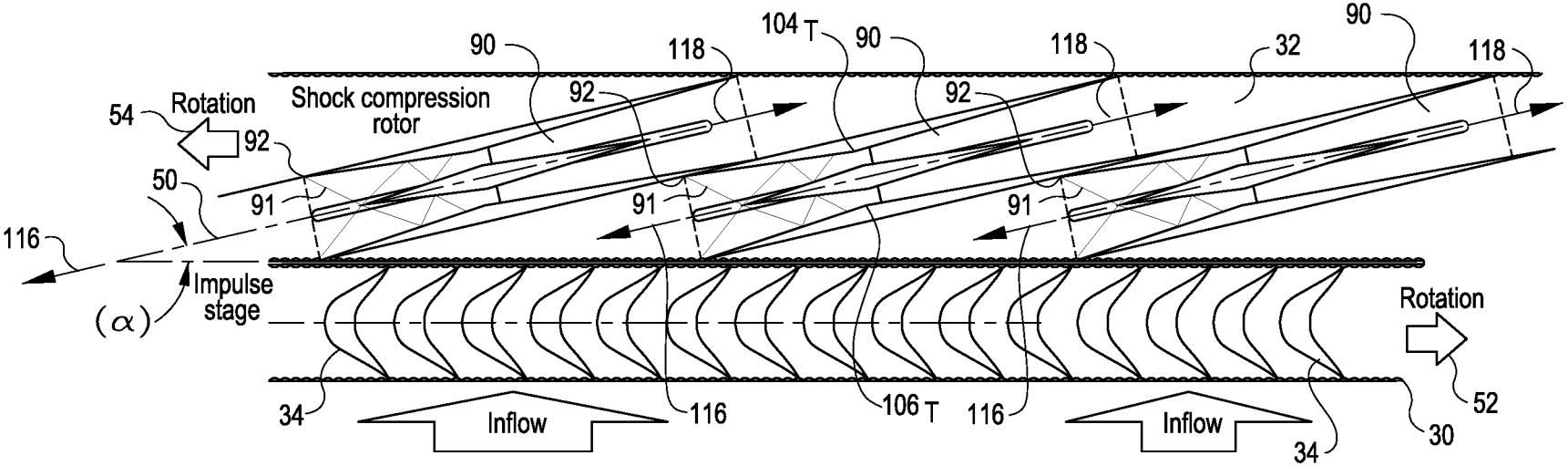
FIG. 3 is a flowpath diagram of the working fluid in the counter-rotating rotors just illustrated in FIG. 2 above, showing inflow of the working fluid to the impulse blades of the first rotor, and then the leading edge of the passageways on the second rotor, where the passageways are angled toward the first rotor for efficiently receiving the working fluid therefrom; the directional areas at each end of the shockwave generating centerbody in each of the passageways shows the direction(s) of movement available for each shockwave generating centerbody.

In FIG. 1, the second rotor 32 is shown without peripheral shroud 40 as seen in FIG. 2, and thus, the internal components of second rotor 32 are now visible in the perspective view of FIG. 1. In an embodiment, a plurality of passageways 42 having converging 44 and diverging 46 sidewalls, and floor 48, are provided. The converging-diverging passageways 42 are oriented along longitudinal centerlines 50 that are offset toward the first rotor 30 by an angle of attack alpha (a), as seen in FIG. 3. Also as depicted in FIG. 3, the first rotor 30 rotates in a first direction 52, and the second rotor 32 rotates in a second direction 54, wherein the second direction 54 is opposite in rotation from the first direction 52, to provide a counter-rotating compressor configuration.

Figure 7:
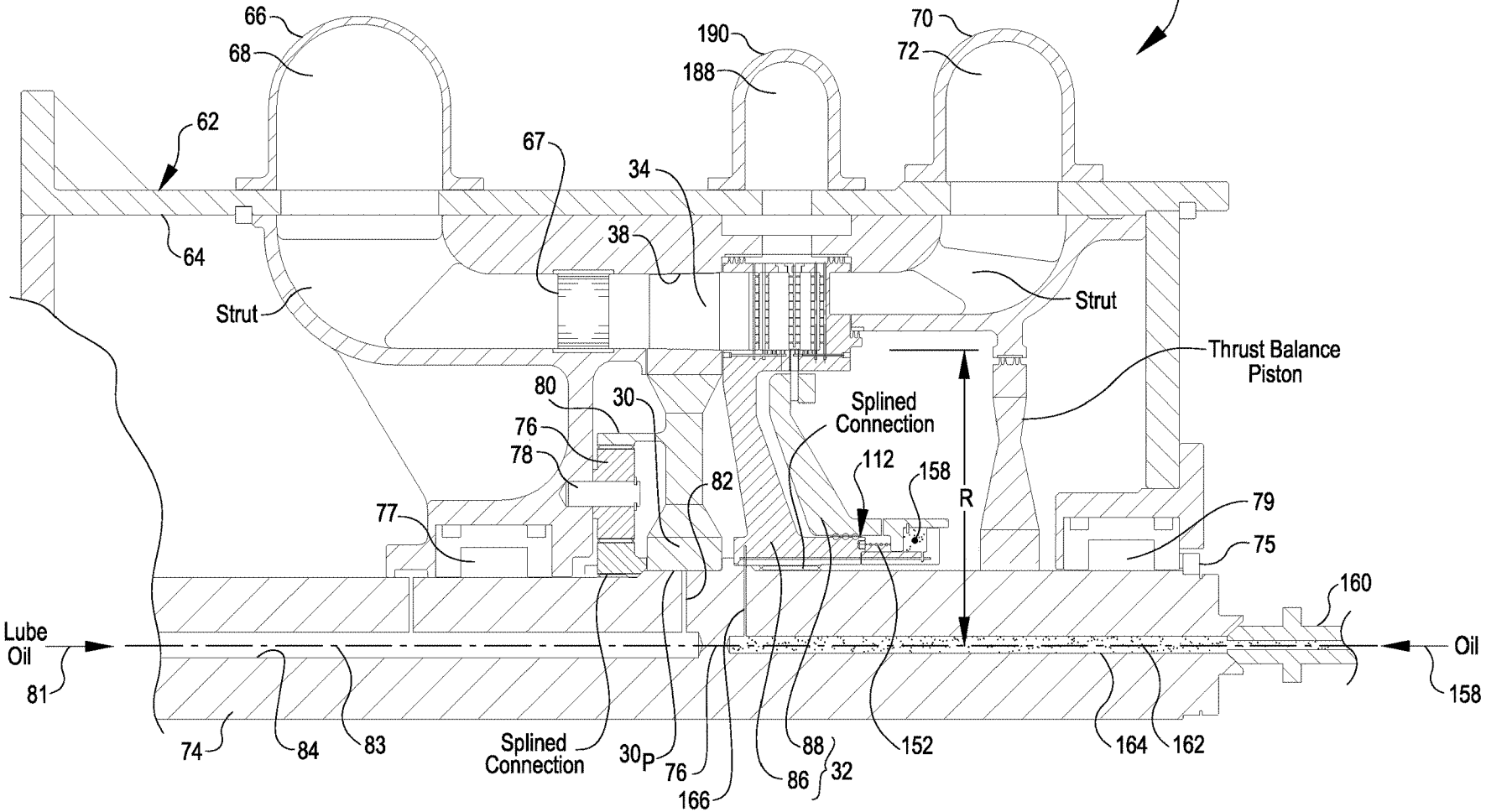
FIG. 7 is a vertical cross-sectional view of an embodiment for an exemplary supersonic compressor, wherein a first rotor uses impulse blades, and wherein a second rotor includes a fixed second rotor portion and an adjustable second rotor portion, with the adjustable second rotor portion in an axially extended position for starting the compressor, and which also shows a working fluid inlet, boundary layer bleed holes which allow working fluid to escape to and out though a bleed outlet, and a compressed gas outlet, as well as a common first shaft for driving a first rotor and a second rotor in a first stage of a compressor.
Figure 8:
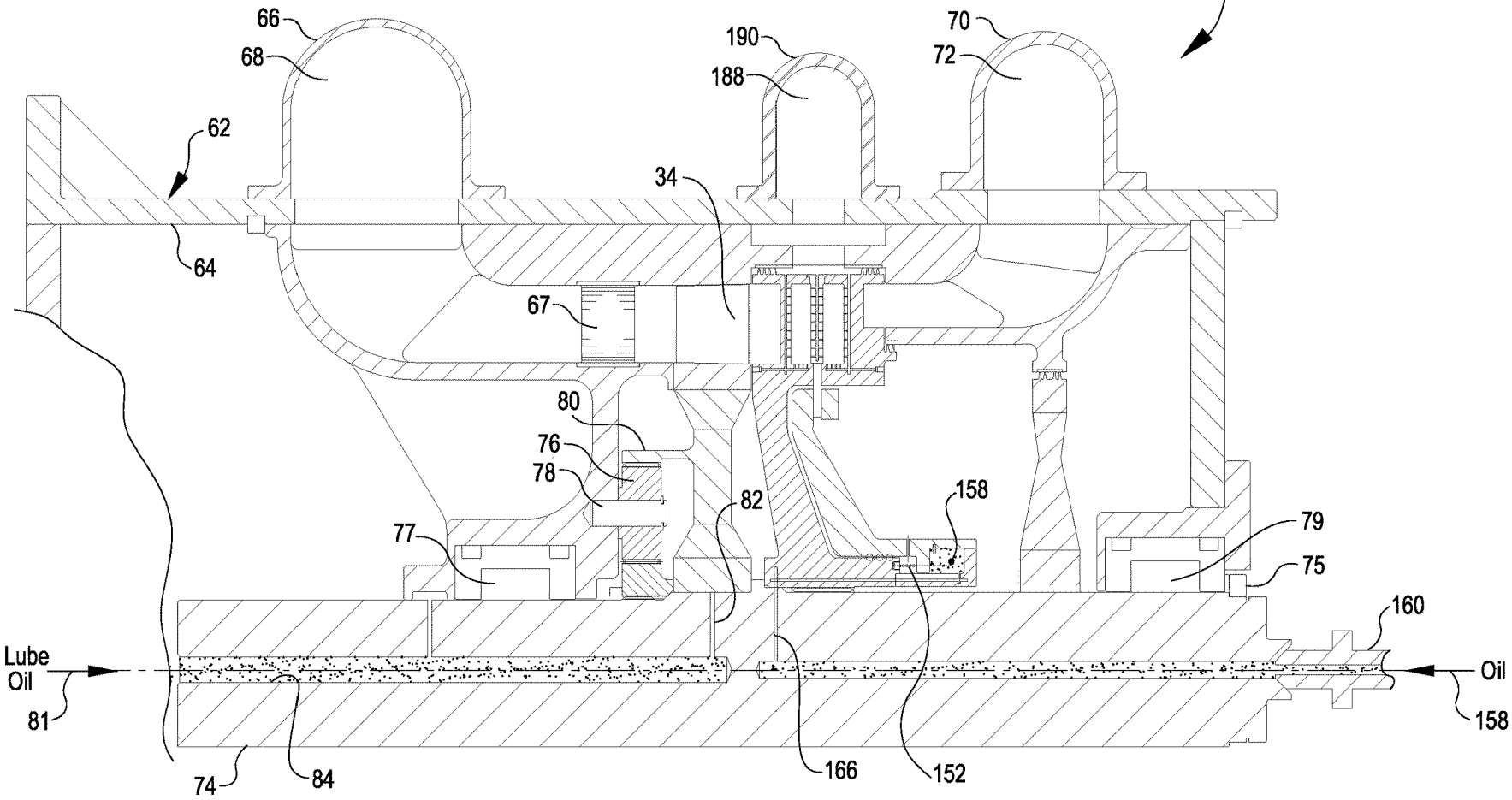
FIG. 8 is a vertical cross-sectional view of an embodiment for an exemplary supersonic compressor, as just illustrated in FIG. 7 above, but now showing an adjustable second rotor portion in a compact position, axially, where a shockwave generating body in a passageway is at an upstream, operating position, as may be positioned for optimum efficiency and stable gas compression operation under supersonic conditions; the other components remain as noted in FIG. 7 above, including a working fluid inlet, boundary layer bleed holes which allow working fluid to escape to and out though a bleed outlet, and a compressed gas outlet, as well as a common first shaft for driving a first rotor and a second rotor in a first stage of a compressor.
Figure 9:
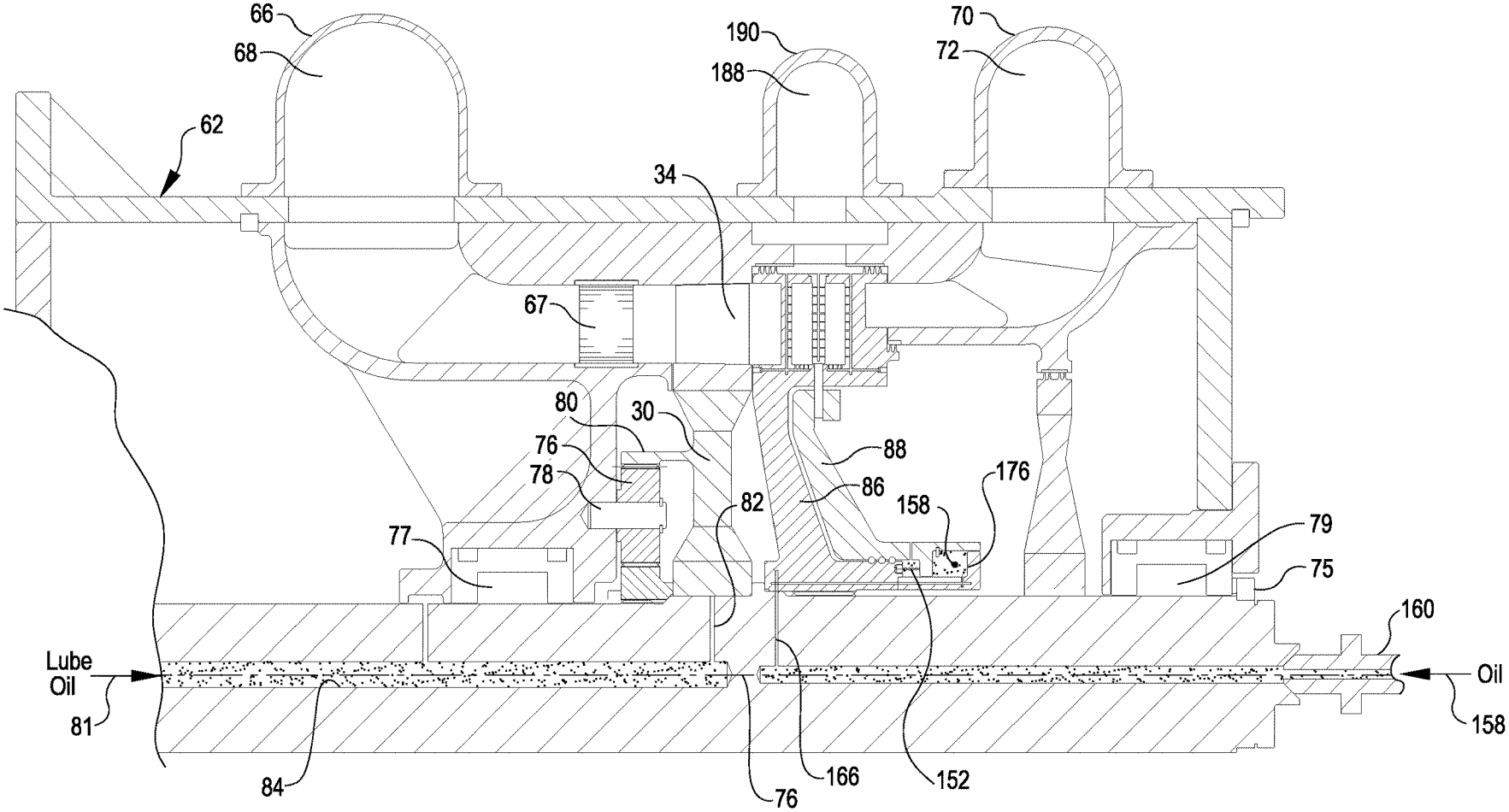
FIG. 9 is a cross-sectional view of an embodiment for an exemplary supersonic compressor as just illustrated in FIG. 8 above, now additionally showing portions of a pressure case, as well as showing an embodiment for the geared interface between the fixed second rotor portion and the adjustable second rotor portion, including the helical grooves on the nipple portion of the fixed second rotor portion, and the helical grooves in the hub of the adjustable second rotor portion, as well as the ball bearings between the respective helical grooves.

An exemplary overall structure for an embodiment of a supersonic gas compressor 60 may be appreciated from FIGS. 7, 8, and 9. In an embodiment, a gas compressor 60 includes a pressure case 62 having a peripheral wall 64, an inlet 66 for supply of a working fluid 68 (i.e. gas in the inlet 66 volute), inlet guide vanes 67 prior to compression, and an outlet 70 for compressed gas 72 (in outlet 70). A first drive shaft 74 extends along a first central axis 76. The first draft shaft 74 may be secured for rotary motion by and between radial bearing 77 and radial thrust bearing 79, the latter of which works against thrust shoulder 75. The first rotor 30 is driven by the first drive shaft 74 for rotary motion in a first direction 52 (See FIGS. 2 and 3) within the pressure case 62. In an embodiment, the first rotor 30 may be driven indirectly by first drive shaft 74 by way of a planet gear 76 on fixed shaft 78 and ring gear 80, which are configured to drive the first rotor 30 in a counter-rotating fashion with respect to second rotor 32. The proximal, shaft side 30P of first rotor 30 may be lubricated by lube oil 81 through a radially extending first oil supply passageway 82, which may extend from a first central oil supply bore 83 defined by first oil supply sidewalls 84 in first drive shaft 74.

Figure 4:
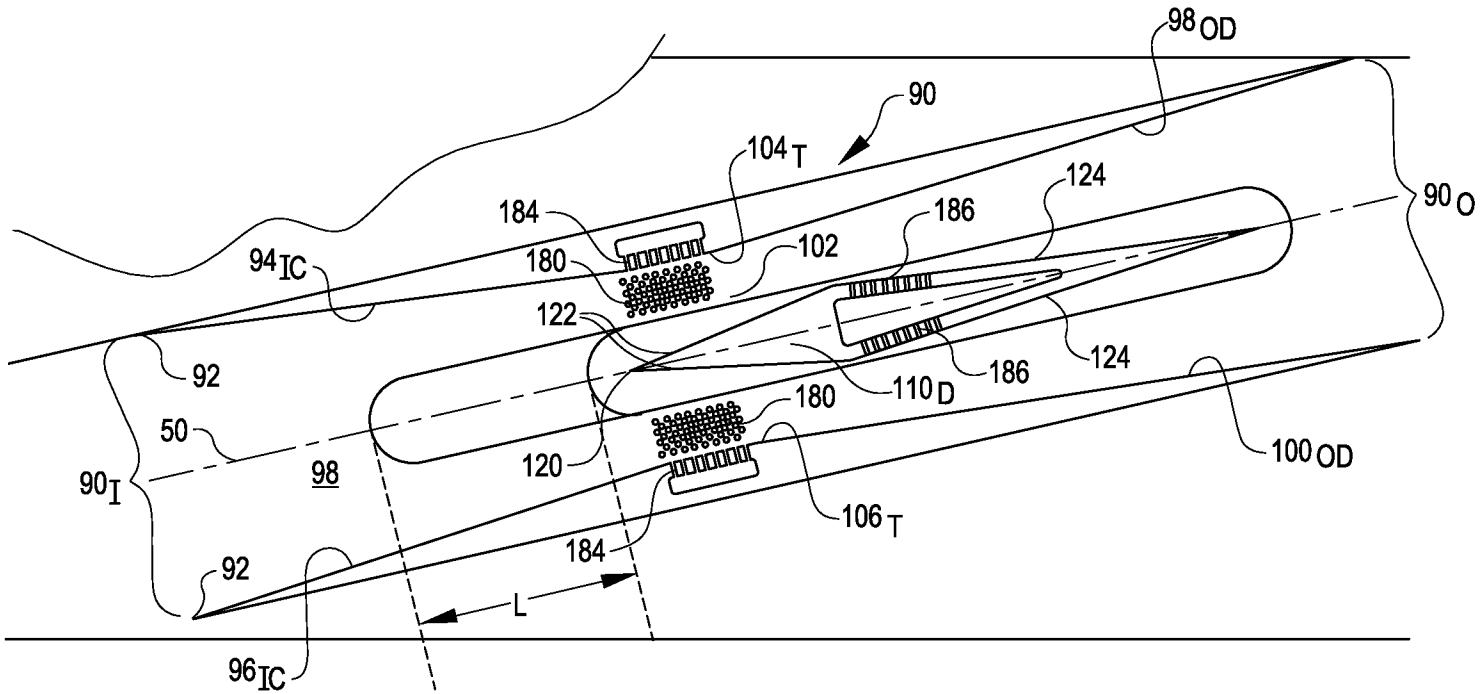
FIG. 4 shows the arc length L available for movement of an embodiment using a diamond shaped shockwave generating centerbody in a passageway on the second rotor, and additionally shows the use of plurality of boundary layer bleed holes in the floor of the passageway, and in the sidewalls of the passageway, and in an embodiment, in the sides of the centerbody itself.

As also seen in FIG. 7, the second rotor 32 is driven by a first drive shaft 74 for rotary motion in a second direction 54 within the pressure case 62. In an embodiment, the second rotor 32 may include a fixed second rotor portion 86 and an adjustable second rotor portion 88. As seen in FIGS. 3 and 4, the second rotor 32 may include a plurality of converging-diverging passageways 90 configured for supersonic compression of gas. The converging-diverging passageways 90 having an inlet 901 which generates an initial shock wave 91 with an initial shock wave generating surface 92 (see half-sections illustrated in FIGS. 13 and 14). The passageways 90 include inwardly converging opposing inlet sidewalls $\mathbf{94}_{IC}$ and $\mathbf{96}_{IC}$, outwardly diverging outlet sidewalls $\mathbf{98}_{OD}$ and $\mathbf{100}_{OD}$, and ends at outlet $\mathbf{90}_{O}$. Passageways 90 have a floor 98, and a ceiling provided by the underside $\mathbf{40}_{U}$ of peripheral shroud 40 (see FIG. 11). As seen in FIG. 4, a throat 102 is defined between the minimal cross-sectional points $\mathbf{104}_{T}$ and $\mathbf{106}_{T}$.

Figure 12:
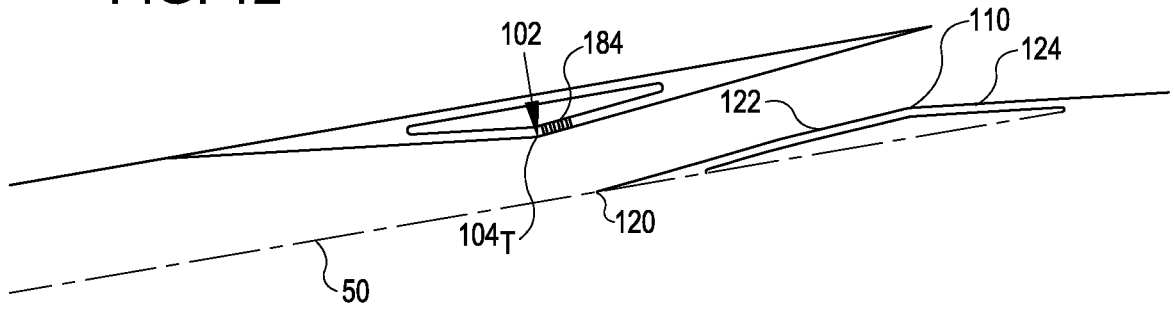
FIGS. 12, 13, and 14 illustrate (using half of a passageway and assuming use of symmetrical passageways) exemplary locations to which shockwave generating bodies may be moved, depending on the operational status of the supersonic compressor.
Figure 13:
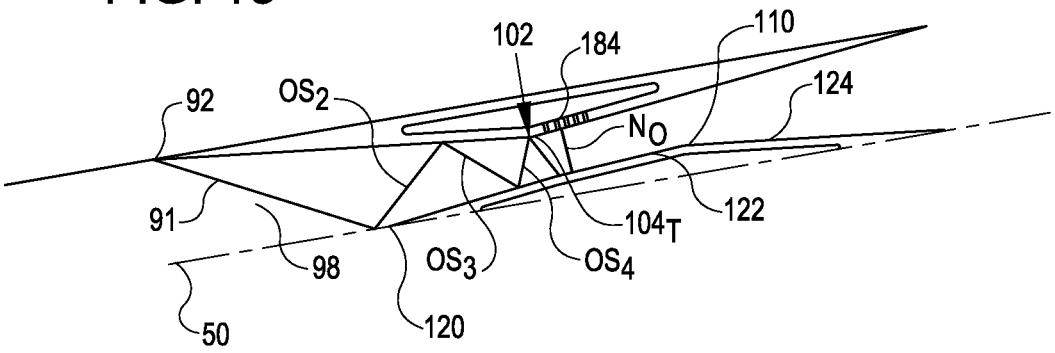
Figure 14:
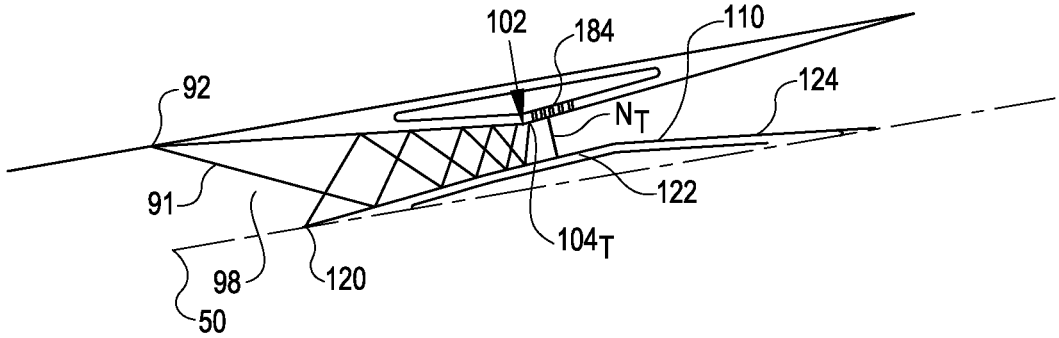

A shockwave generating body 110 extends outward from the adjustable second rotor portion 88 into each of the fixed second rotor portion passageways 90. Each shockwave generating body 110 is translatable, i.e. can move back and forth. In an embodiment, movement of each shockwave generating body 110 may be as driven, preferably with precision, by use of a geared interface 112 (see FIG. 7 or FIGS. 10 and 10A), or other adjustment mechanism which provides simultaneous axial and circumferential movement of the shockwave generating body 110 relative to the first drive shaft 74, and within passageway 90, and along the longitudinal axis 50 thereof. Movement of each shockwave generating body 110 along a longitudinal axis 50 of the passageway 90 may be upstream as indicated by arrows 116 in FIG. 1 or 3. Movement of each shockwave generating body 110 along a longitudinal axis 50 of the passageway 90 may be downstream as indicated by arrows 118 in FIG. 1 or 3. As seen in FIG. 4, a shockwave generating body 110 may be a diamond shaped shockwave generating body $\mathbf{110}_{O}$, having a leading edge 120 and diverging walls 122 on the upstream portion, and converging walls 124 on the downstream portion. Thus, movement of the shockwave generating bodies 110 along a path of length L as seen in FIG. 4, provides an increase or decrease in the cross-sectional area of the throat portion 102, i.e. adding to or subtracting from the total open area available at the throat 102, depending on the position of the shockwave generating body 110, and the then present flow obstructing cross-sectional area of the shockwave generating body 110 at the throat 102. Thus, in various embodiments, the throat 102 of each of the passageways 90 is provided with a variable cross-sectional area. Consequently, the cross-sectional area of throat 102 may be increased for starting, as seen in FIG. 12, which allows a startup normal shock Ns captured during startup (see FIG. 15) to be "swallowed" through the throat 102. Then, spill of a working gas via a boundary layer bleed system (discussed below) may be reduced or terminated, and the shockwave generating body 110 may be moved upstream, to a position of maximum efficiency, as seen in FIG. 13, to an operating position normal shock No. Additionally, the upstream 116 and downstream 118 adjustment of the shockwave generating body 110 allows optimum positioning of a turndown position normal shock $N_T$ during part load operation (see FIG. 14), further increasing efficiency of operation of compressor 60 when mass flow of the working fluid has been reduced from the design mass flow at normal full load operation. As a result of the movement of the shockwave generating body 110 as just described, the compressor 60 design disclosed herein enables easy startup, and fine adjustment of operating position normal shock No position during normal operation, to provide a workable supersonic compressor design.

Figure 6:
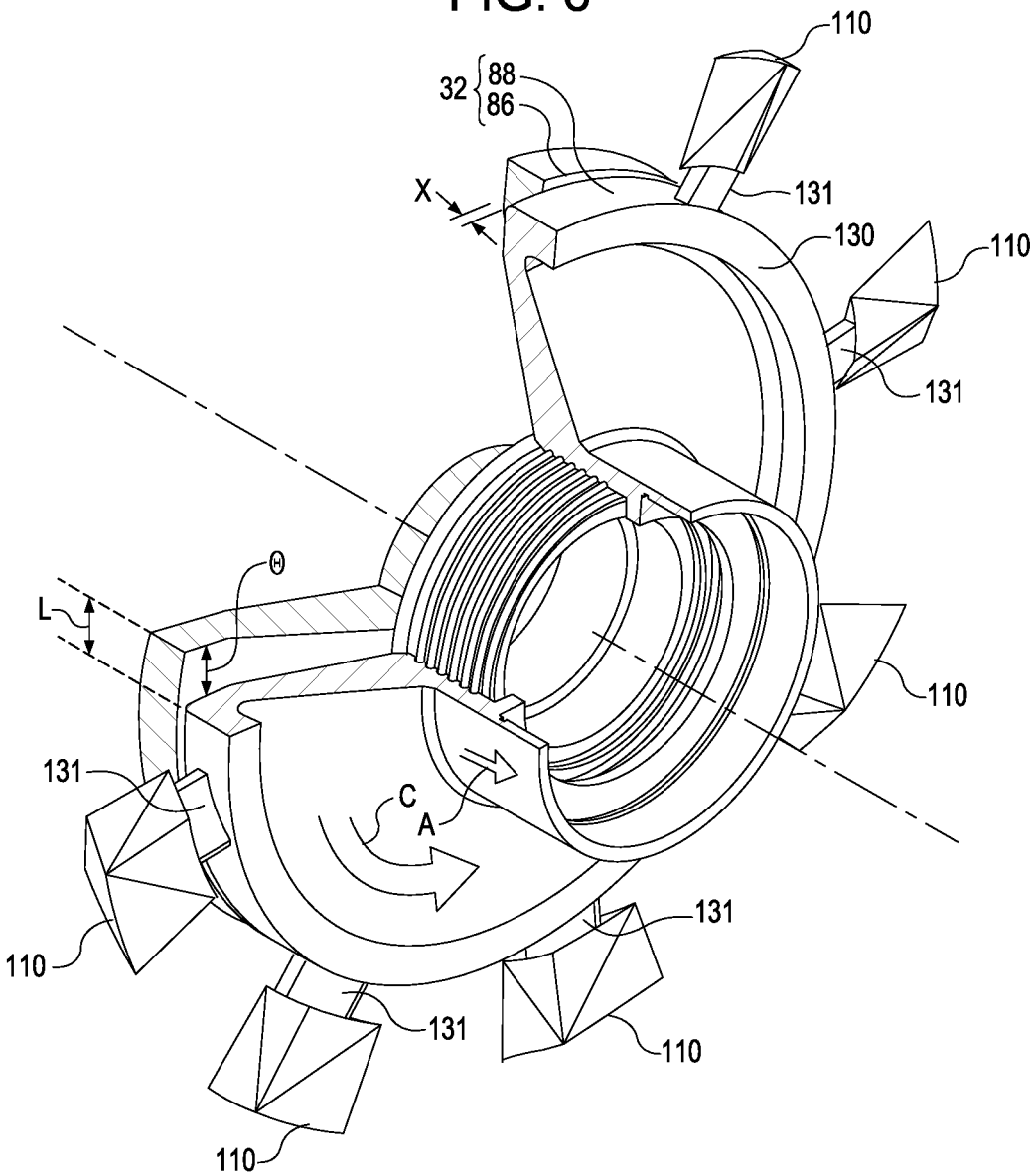

In FIG. 7, it can be seen that in an embodiment, the passageways 90 have a radially inward floor 98 at radius R from the first central axis 76. The adjustable second rotor portion 88 is adjustable with respect to the fixed second rotor portion 86 (in the direction of reference arrow C in FIG. 6) by a circumferential angle theta (θ), as seen in FIG. 6, so that the shockwave generating body 110 is translatable for an arc distance of length L (also see FIG. 4). In an embodiment, the adjustable second rotor portion 88 is configured for axial movement (direction of reference arrow A in FIG. 6) away from the fixed second rotor portion 86 by an axial distance X, as noted in FIG. 6. As noted above, the movement of the adjustable second rotor portion 88 provides for translating movement of the shockwave generating body 110 either upstream or downstream along a longitudinal flowpath centerline 50 of the passageway 90 in which it is located. In various embodiments, each passageway may be symmetrical to each side along a longitudinal axis 50 at the centerline thereof. With both axial and circumferential movement of the adjustable second rotor portion 88 with respect to the fixed second rotor portion 86, each shockwave generating body 110 is translatable in a helical path relative to the first central axis 76.

As noted above, in an embodiment, the impulse blades 34 on first rotor 30 may be unshrouded. However, in an embodiment, each of the passageways 90 may include a peripheral shroud 40. As seen in FIG. 2, in an embodiment, the peripheral shroud 40 may be provided in the form of a thin cylindrical annular ring, the underside $\mathbf{40}_U$ of which provides a circumferentially extending roof for passageways 90. In an embodiment, such a thin cylindrical annular ring peripheral shroud 40 may encompass all of the passageways 90 on the fixed second rotor portion 86.

Figure 5:
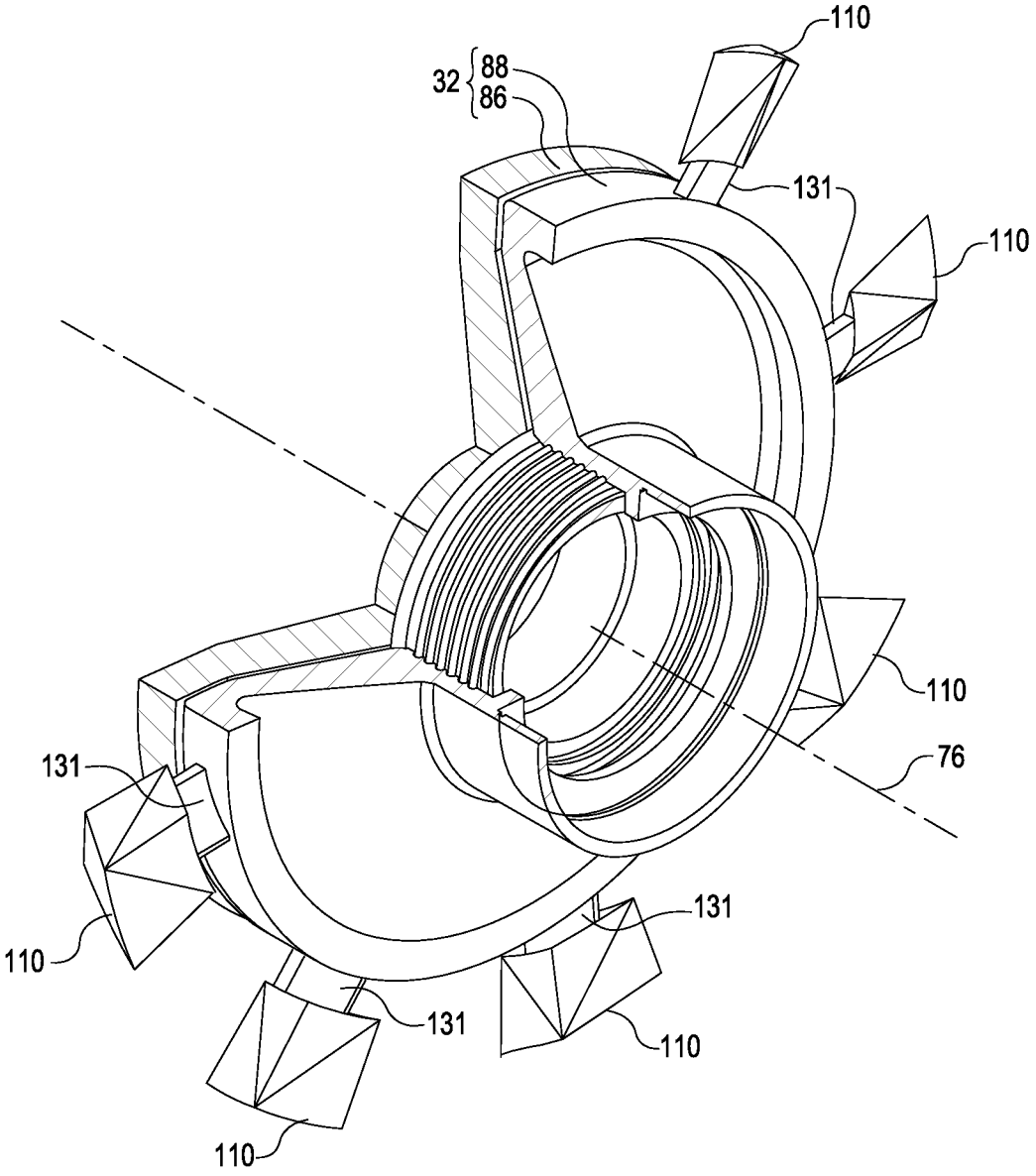
FIGS. 5 and 6 illustrate the basic design of the second rotor, which includes a fixed second rotor portion and an adjustable second rotor portion; these figures illustrate the circumferential and axial adjustment which may be provided using a gear interface with helical grooves provided between the fixed second rotor portion and the adjustable second rotor portion.

As seen in FIGS. 5 and 6, in an embodiment, the adjustable second rotor portion 88 may include an annular outer edge 130. In an embodiment, each shockwave generating body 110 may be affixed to the annular outer edge 130 by a support pedestal 131.

Figure 10:
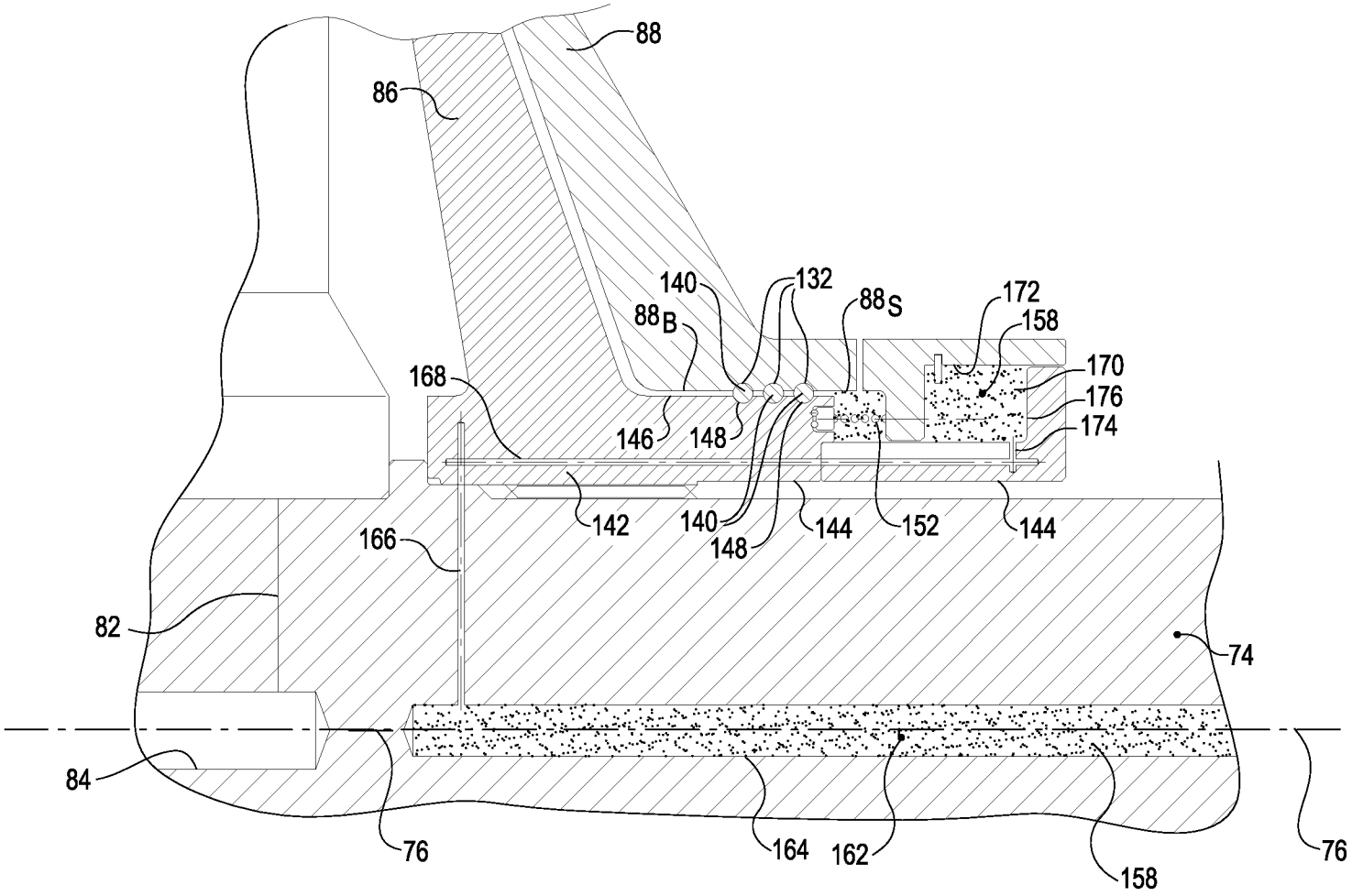
FIG. 10 is a cross-sectional view showing details of an embodiment for a design for a geared interface between the fixed second rotor portion and the adjustable second rotor portion, including the helical grooves on the nipple portion of the fixed second rotor portion, and the helical grooves in the hub of the adjustable second rotor portion, as well as the ball bearings between the respective helical grooves, as well as the compression spring for biasing the adjustable second rotor portion toward an normally closed position, without axial separation from the fixed second rotor portion, and also showing oil passageways with an internal end closure, for pressurizing the oil receiving in the adjustable second rotor portion toward a fully closed, axially compressed position against the fixed second rotor portion, as illustrated in this drawing figure.
Figure 10A:
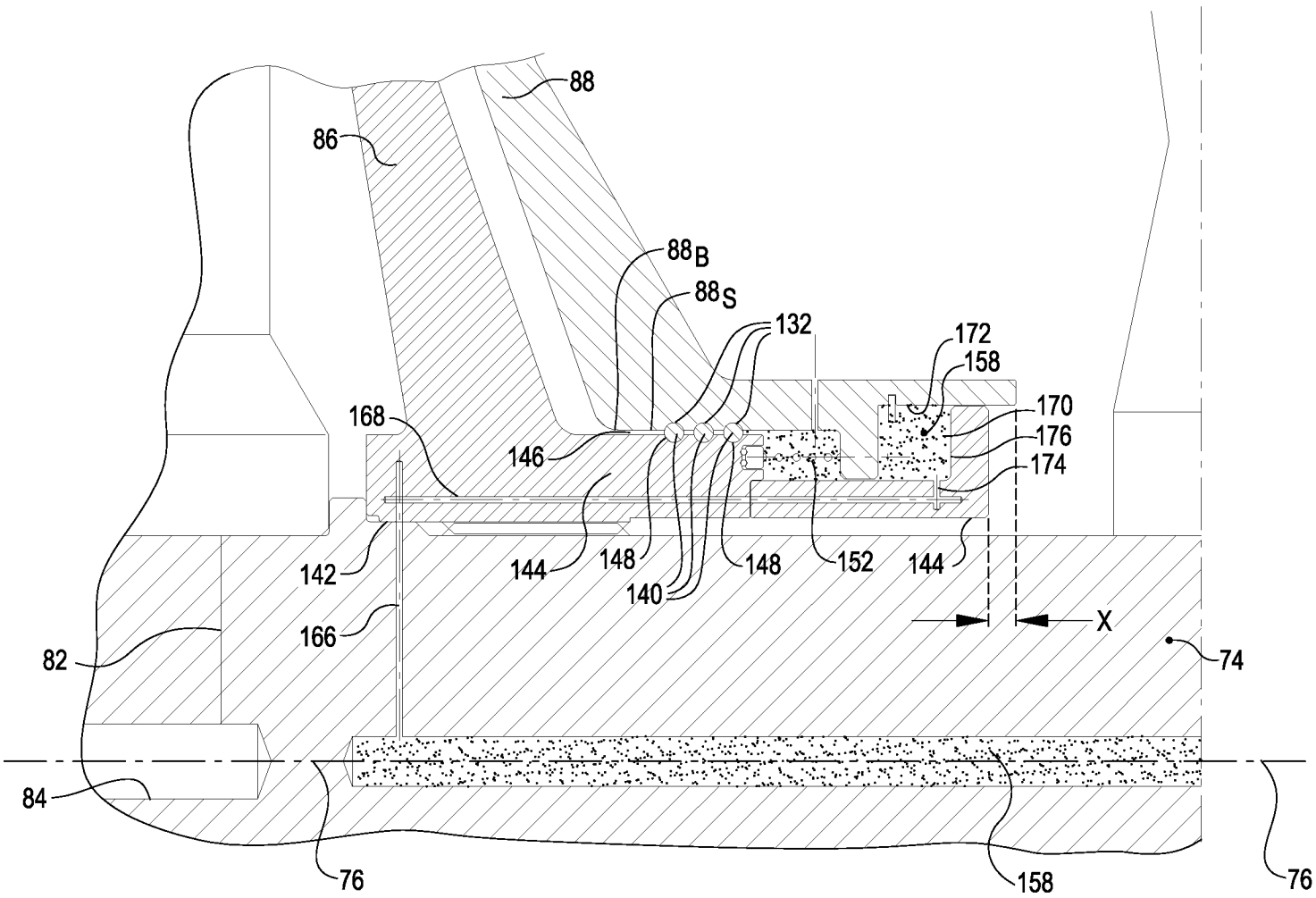
FIG. 10A is similar to FIG. 10, and is also a cross-sectional view showing details of an embodiment for a design for a geared interface between the fixed second rotor portion and the adjustable second rotor portion, including the helical grooves on the nipple portion of the fixed second rotor portion, and the helical grooves in the hub of the adjustable second rotor portion, as well as the ball bearings between the respective helical grooves, as well as the compression spring for biasing the adjustable second rotor portion toward an axially extended, normally open position, axially separated from the fixed second rotor portion.

Turning now to FIGS. 10 and 10A, in an embodiment, a geared interface 112 may include a first hub bore $\mathbf{88}_B$ in the adjustable second rotor portion 88, where the hub bore $\mathbf{88}_B$ has an interior surface 88*s* comprising a plurality of first helical grooves 132 sized and shaped for receiving ball bearings 140 of complementary size and shape therein. In an embodiment, the geared interface 112 may include a second hub bore 142 in the fixed second rotor portion 86. A nipple portion 144 extends axially outward, and the nipple portion 144 includes an external surface 146. The external surface 146 includes a plurality of second helical grooves 148 sized and shaped for receiving ball bearings 140 of complementary size and shape therein. In an embodiment, the plurality of ball bearings 140 are located between the first helical grooves 132 in the first hub bore $\mathbf{88}_B$ and the second helical grooves 148 in the nipple portion 144 of the fixed second rotor portion 86. The ball bearings 140 are sized and shaped for adjustable engagement between the fixed second rotor portion 86 and the adjustable second rotor portion 88. The adjustable engagement provides for helical movement of the adjustable second rotor portion 88 relative to the fixed second rotor portion 86. During such movement, each shockwave generating body 110 remains disposed along the longitudinal axis 50 of the passageway 90 in which it is located. In an embodiment, the ball bearings 140 are sized so as to provide tight fitment and constant contact between the ball bearings 140 and the first helical grooves 132 and the second helical grooves 148, thereby allowing precision adjustment between the fixed second rotor portion 86 and the adjustable second rotor portion 88. In an embodiment, a helical angle delta (Δ) of the first helical grooves 132 and a helical angle sigma (σ) of the second helical grooves 148 are each selected so that circumferential and axial movement of the adjustable second rotor portion with respect to the fixed second rotor portion results in movement of the body along a longitudinal centerline of the passageway in which it is located. Such adjustable engagement provides for the helical movement of the adjustable second rotor portion 88 relative to the fixed second rotor portion 86, so that each shockwave producing body 110 moves axially and arcuately, while remaining disposed along the longitudinal axis 50 of the passageway 90 in which it is located. Consequently, in an embodiment, the helical angle delta (Δ) of the first helical grooves 132 and a helical angle sigma (σ) of the second helical groove 148 are the same as the angle of attack alpha (α) of the passageways 90.

In various embodiments, a helical adjuster may be provided to adjustably secure helical adjustments between the fixed second rotor portion 86 and the adjustable second rotor portion 88, as described herein. In various embodiments, helical adjustments may be provided using a geared interface 112, which may include using at least one component including helical grooves and ball bearings as described above. In various embodiments, a geared interface 112 may be provided using at least one component including use of a helical spline. In various embodiments, a geared interface 112 may be provided using at least one component including use of a worm gear. In various embodiments, a geared interface 112 may be provided using at least one component including use of a guide slot with cam follower. In any event, means for axial and circumferential adjustment between the fixed second rotor portion 86 and the adjustable second rotor portion 88 as workable to facilitate provision of an arcuately translatable shockwave generating body 110 are necessary to obtain maximum benefit of the compressor design disclosed herein.

As further evident in FIGS. 10 and 10A, the adjustable second rotor portion 88 is axially adjustable away from the fixed second rotor portion 86 by an axial length X (see FIG. 10A). In an embodiment, such movement may be facilitated by use of an adjustable pressure oil system, which may be provided by a servo-electric hydraulic control system 150, as noted in FIG. 18. Basically, an increase in oil pressure forces the adjustable second rotor portion 88 toward the fixed second rotor portion 86, which moves the shockwave generating bodies 110 further upstream toward the first rotor 30, and consequently decreases the cross-sectional area of throat 102. In the absence of oil pressure, for instance should the oil system pressure fail, then a compression spring 152, which is in place to bias the adjustable second rotor portion 88 away from the fixed second rotor portion 86, moves the adjustable second rotor portion 88 axially away from the fixed second rotor portion 86. That motion moves the shockwave generating bodies 110 further downstream in passageways 90, away from the first rotor 30, and thus minimizes the chance of a compressor "unstart" or stall in the event of loss of oil pressure.

An embodiment for a workable oil system configuration is suggested in FIGS. 10 and 10A. Operation is as set forth above. Oil 158 may be supplied from a stationary hydraulic oil nipple 160 (see FIG. 7) which receives oil from the servo-electric hydraulic control system 150 (see FIG. 18. Oil 158 enters an oil passageway 162 defined by sidewalls 164 in first drive shaft 74. A radially extending oil passageway 166 is provided from oil passageway 162 to the fixed second rotor portion 86. An axially extending oil passageway 168 to provides oil 158 to an oil gallery 170, defined between and by an external passageway sidewall 172 in the hub of the adjustable second rotor portion 88 and an internal passageway 174 having an end closure 176 in the nipple portion 144 of the fixed second rotor portion 86. The oil gallery 170 is configured for receiving and containing therein oil 158 for urging the adjustable second rotor portion 88 axially away from the end closure 179 of the internal passageway of the fixed second rotor portion 86, and thus toward the fixed second rotor portion 86, as seen in FIG. 10A.

As noted above, in an embodiment, a compression spring 152 may be provided, configured to urge the adjustable second rotor portion 88 axially away from the fixed second rotor portion 86 when pressure of oil 158 in the oil gallery 170 is insufficient to urge the adjustable second rotor portion 88 toward the fixed second rotor portion 86.

Figure 11:
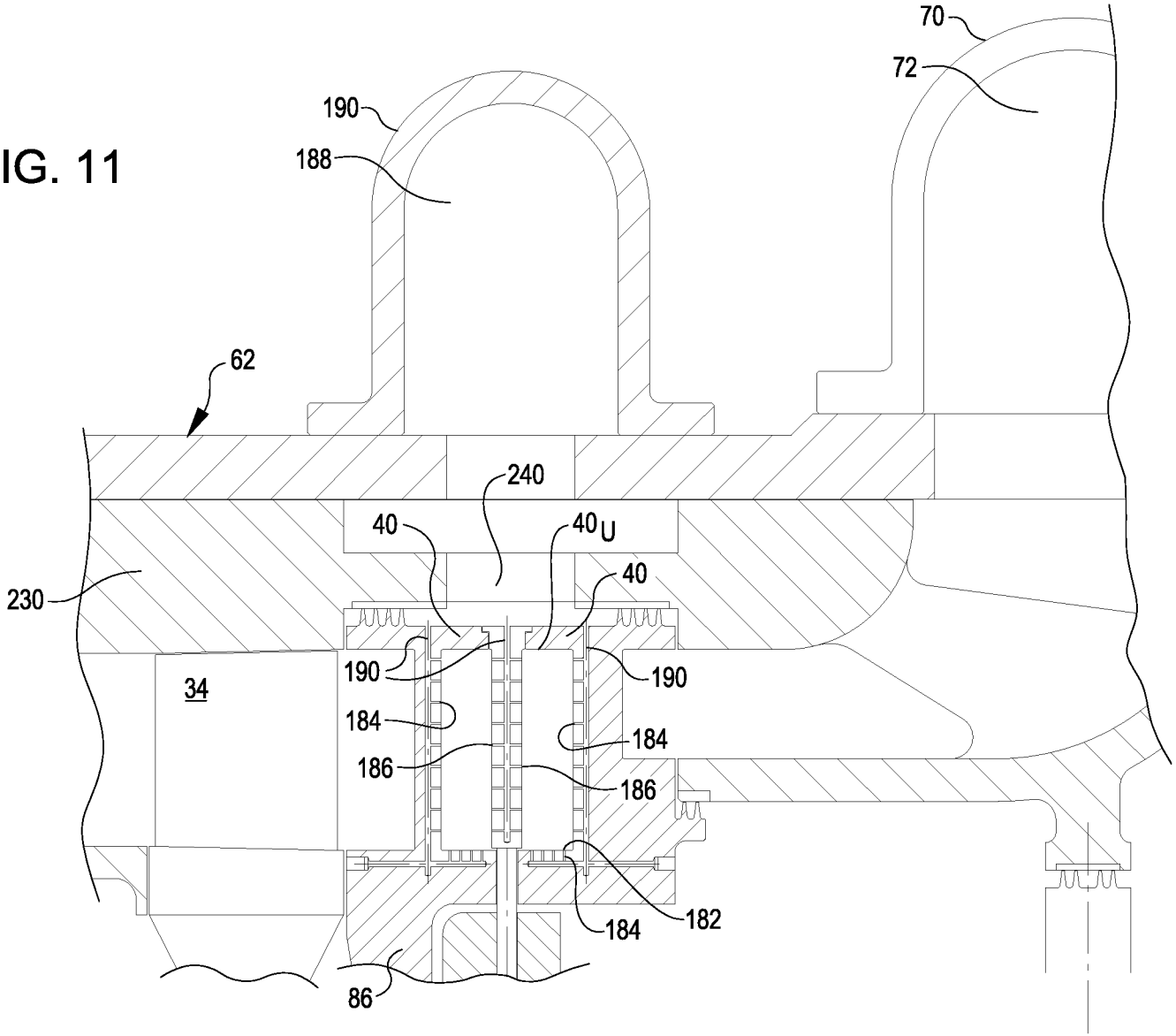
FIG. 11 is a partial vertical cross-sectional view of an embodiment for a passageway in the second rotor, showing the location of a shock generating body, as well as boundary layer bleed holes in the floor of the passageway, in the sides of the passageway, and in both sides of the shock generating body located within the passageway, as well fluid passageways for passing working fluid that escapes from the boundary layer bleed holds to a bleed collector.

The use of boundary layer bleed structures may be appreciated by reference to FIGS. 4 and 11, and are otherwise noted in FIGS. 7, 8, and 9. In various embodiments, passageways 90 include a radially inward floor 98 The passageways 90 may also include floor boundary layer bleed passages 180, which are of course located in the radially inward floor 98. In an embodiment, such floor boundary layer bleed passages 180 may be at or adjacent the throat 102. In an embodiment, as shown in FIG. 5, and also as seen in FIG. 11, the floor boundary layer bleed passages 180 are provided using a plurality of holes 182 in the radially inward floor 98. Holes 182 may be defined by interior sidewalls 184, noted in FIG. 11. In an embodiment, sidewall boundary layer bleed passageways 186 may be provided in sidewalls (e.g. $\mathbf{94}_{IC}$, $\mathbf{98}_{OD}$, $\mathbf{96}_{IC}$, $\mathbf{100}_{OD}$) of the passageway 90, at, or adjacent to throat 102. In an embodiment, body boundary layer bleed passageways 186 may be provided in the shockwave generating bodies 110. In an embodiment, the location of the sidewall boundary layer bleed passageways 186 may correspond to a longitudinal location along a flowpath of gas therein where a normal shock No occurs during supersonic operation of the passageway 90, as seen in FIG. 13. In various embodiments bleed outlets 190 are fluidly connected to boundary layer bleed passageways, for bleed passageways 180, or bleed passageways 184, or bleed passageways 186. In an embodiment, the bleed outlets 190, collectively, are sized and shaped to enable removal of between about seven percent (7.0%) and fifteen percent (15.0%) of the working fluid entering each passageway 90 during startup of the gas compressor 60. In an embodiment, the bleed outlets, collectively, are sized and shaped to enable removal of between about one-half of one percent (0.5%) and two percent (2.0%) of the working fluid entering each passageway 90 during normal operation. The bleed outlets are configured to direct the hot working gas 188 spilled from bleed passageways to the bleed outlets to a bleed collector 190.

Figure 15:
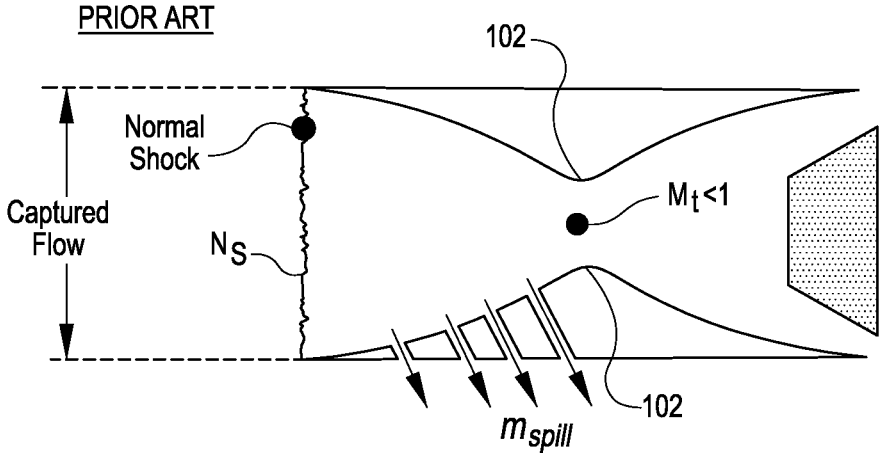
FIG. 15 PRIOR ART
FIG. 15 illustrates the basic principles known in supersonic aerospace applications, and some prior art compressor designs, which involved in the use of mass spill passageways, such as boundary layer bleed passageways, as may be useful in allowing a normal shock Ns located upstream of the throat of a passageway to pass through the throat, thus facilitating startup.
Figure 16:
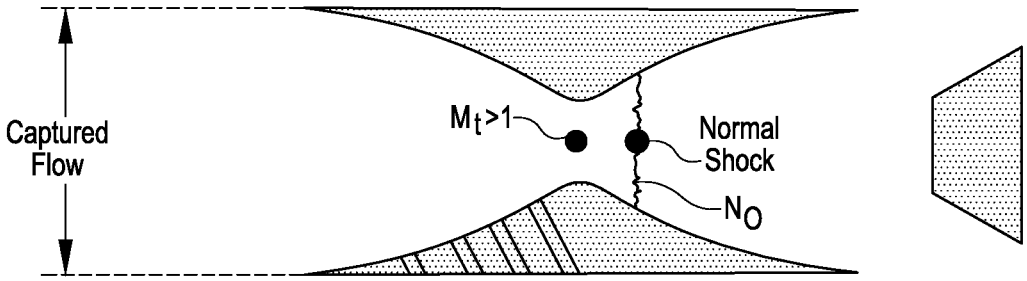
FIG. 16 PRIOR ART
FIG. 16 illustrates the basic principles known in supersonic aerospace applications, and some prior art compressor designs, which involved the use of mass spill passageways, such as boundary layer bleed passageways, as may be useful in allowing a starting normal shock Ns located upstream of the throat of a passageway to pass through the throat, thus facilitating startup to place an operation normal shock No in the operating position, and in this FIG. 16, it shows a fully started supersonic passageway, wherein boundary layer bleed has been discontinued.

As noted above, in various embodiments, the shockwave generating bodies 110 are translatable to a downstream position during startup of compressor operation, enlarge the cross-sectional area at the throat 102, as seen in FIG. 12. As depicted for an exemplary embodiment, in a starting position, the shockwave generating body 110 may be positioned at a location 1.6 inches (about 40.64 millimeters) downstream from throat 102 along centerline 50. Use of boundary layer bleed as just described also assists in spillage of excess mass flow, as depicted in FIG. 15, so that the normal shock Ns occurring during startup can be swallowed through the throat 102. After startup, then the normal shock assumes an operating position No, wherein the shockwave generating body 110 is translated to a neutral position (see FIG. 13) during supersonic compressor operation, where the shockwave generating body is a location 0.0 inches (0.0 millimeters) from the throat 102 while operating at Mach 2.4. During part load operation, the normal shock assumes an operating position $N_T$, wherein the shockwave generating body 110 is translated to a forward position (see FIG. 14) during supersonic compressor operation, where the shockwave generating body is a location 0.625 inches (15.875 millimeters) forward of the throat 102, while operating at Mach 2.6. In the novel compressor design disclosed herein wherein the shockwave generating body 110 is adjustably translatable during operation, design optimization will allow selection of the extent of movement of the shockwave generating body 110 that provides provide an optimum operating efficiency position at a location between an upstream limit position and a downstream limit position.

In an embodiment, a pressure case 62 for a compressor 60 as described herein may be provided in a structure adapted to contain fluids therein at an operating pressure of up to one hundred fifty (150) bar (15000 kilopascals). In an embodiment, the pressure case 62 may be provided in a structure adapted to contain a working fluid therein while operating at a pressure ratio of between about six (6) and about twenty (20). In an embodiment, a compressor 60 as described herein may be provided having an adiabatic efficiency in a range of between about zero point eight nine (0.89) at a pressure ratio of about six (6), and about zero point eight four (0.84) at a pressure ratio of about twenty (20).

Figure 17:
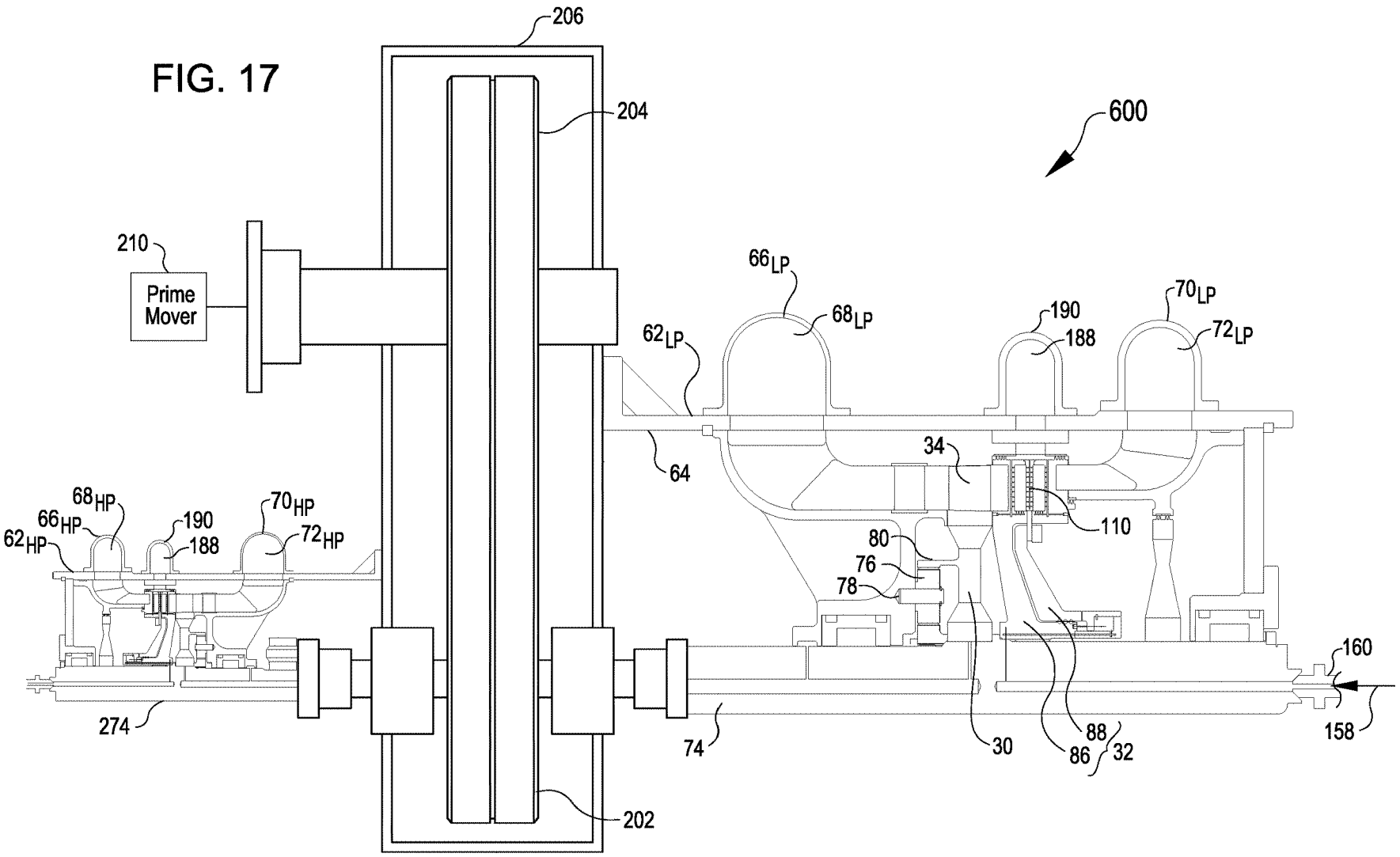
FIG. 17 illustrates the use of a low pressure (LP) stage and a high pressure (HP) stage in a two stage supersonic gas compression system, wherein each stage is driven through a common gear drive assembly.

Attention is directed to FIG. 17, which shows a two stage compressor system 600, which uses a low pressure compressor 60LP and a high pressure compressor 60HP, both driven via drive gears 202 and 204 in gearbox 206. Such a two stage compressor system utilized the various components as noted above, in both the lower pressure compressor 60LP and in the high pressure compressor 60HP. A LP pressure case 62LP is provided, having a LP low pressure inlet 66LP and a LP high pressure outlet 70LP. A first drive shaft 74 extends along a first central axis 76 as noted above, and into the LP pressure case 60LP. A HP pressure case 62HP is provided. The HP pressure case 62HP includes a HP low pressure inlet 62PH and a HP high pressure outlet 70HP. A second drive shaft 274 extends along a second central axis 276 and into the HP pressure case 62HP. The LP compressor 60LP stages may be configured as set out above. The HP compressor stage 60HP may be configured as set out above.

Figure 18:
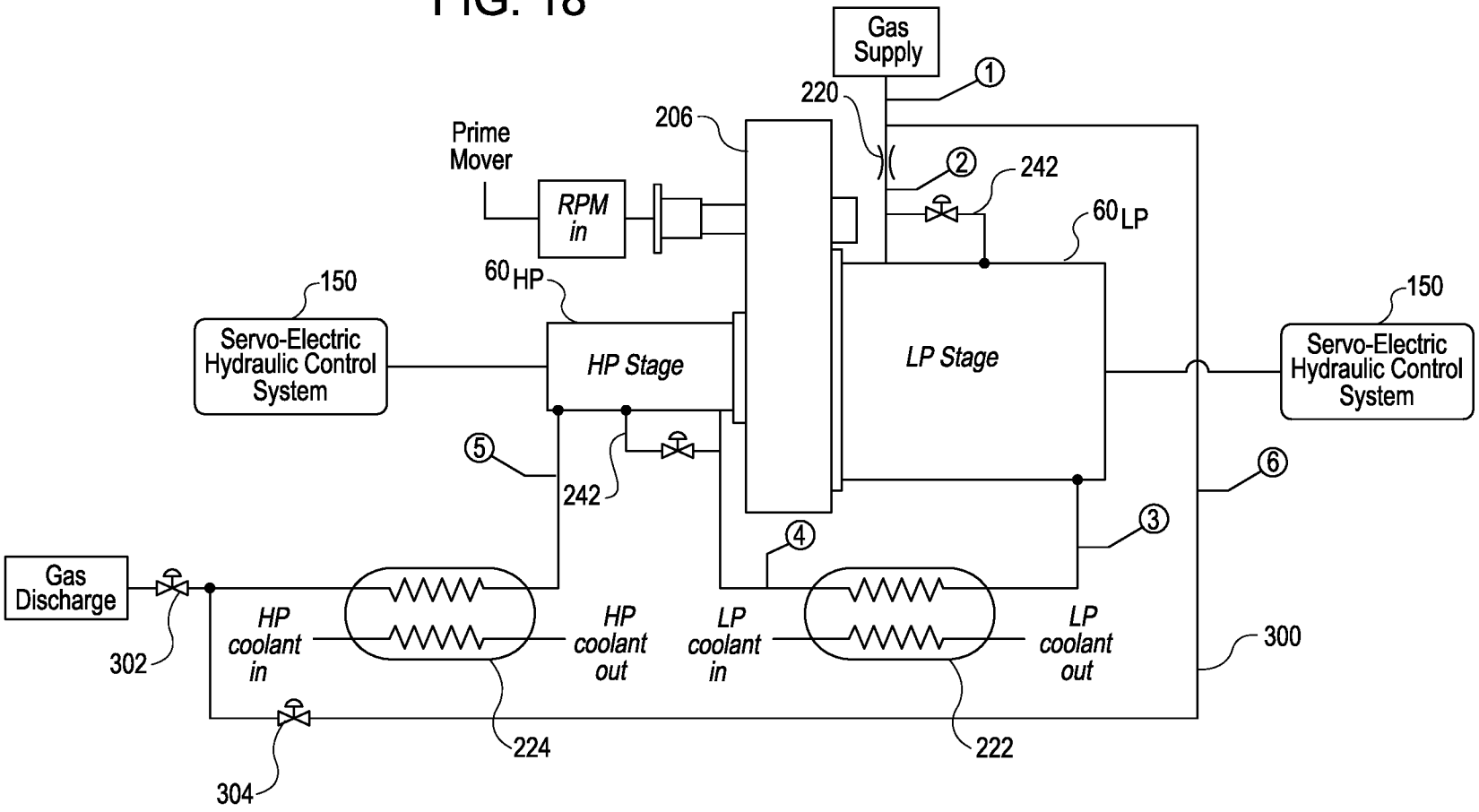
FIG. 18 illustrates the use of a low pressure (LP) stage and a high pressure (HP) stage in a two stage supersonic gas compression system, wherein each stage is driven through a common gear drive assembly, and further showing the use of intercoolers for (a) cooling the compressed gas from the LP compression stage, and (b) for cooling the compressed gas from the HP compression stage, as well as identifying a number of process locations with respect to which various properties are provided in Table 2, as well as showing the use of hydraulic servo-electric systems for providing oil pressure and regulating such pressure to move the adjustable second rotor portion as desired, such as between startup, normal operation, and part-load conditions, or as regards fine adjustments as necessary or desirable to accommodate varying conditions such as changes in mass flow of the working fluid, or changes in pressure and/or temperature of the working fluid.

For actual operation, as depicted in FIG. 18, intercooling may be utilized. As an example, compression of carbon dioxide is modeled and conditions are noted in Table 2. Carbon dioxide gas from a gas supply is provided at conditions of reference point (1) as set out in Table 2. For part load operation, throttle valve 220 may choke the incoming working fluid. See FIG. 19A, which provides diagrammatic location data for reference points (1), (2), and (3) as set out in Table 2 when compressor throttling is used. Full load and exemplary part load conditions are set out in Table 2. Discharged compressed gas has conditions set out at reference point (3), as noted in Table 2. A LP coolant is fed to a LP heat exchanger 222, to cool discharged pressurized gas 72LP at exemplar conditions at reference point (3) as provided in Table 2. The cooled pressurized gas from the LP stage has conditions as set out for reference point (4) in Table 2. The HP stage, 60HP further compresses the working fluid to provide a heated high pressure discharge gas 72HP, which has the conditions noted for reference point (5) in Table 2. The heated high pressure discharge gas 72HP is fed to a high pressure heat exchanger 224, and a HP coolant is fed to the heat exchanger 224 to cool the gas for discharge.

TABLE 2

| | | Station (all conditions stagnation) | | | | | |
|---|---|---|---|---|---|---|---|
| | Property | 1 | 2 | 3 | 4 | 5 | 6 |
| Design | P (psia) | 17.22 | 17.22 | 176.27 | 168.97 | 1,747.09 | |
| (100% | T (F) | 79.4 | 79.4 | 444.5 | 112.89 | 513.99 | |
| flow) | Rho (pcf) | 0.1164 | 0.1164 | 0.7818 | 1.1197 | 7.4869 | |
| $RPM_{in}$ = | a (fps) | 868.62 | 868.62 | 1112.95 | 871.57 | 1159.14 | |
| 3,600 | gamma (— | 1.2991 | 1.2991 | 1.2427 | 1.3415 | 1.3402 | |
| | flow (pps) | 50 | 50 | 50 | 50 | 50 | 0 |
| Throttled | P (psia) | 17.22 | 12.5 | 150.86 | 144.76 | 1747.1 | |
| (70% | T (F) | 79.4 | 79.4 | 486.3 | 112.9 | 551.8 | |
| flow) | Rho (pcf) | 0.1164 | 0.0955 | 0.6579 | 1.0831 | 7.3507 | |
| $RPM_{in}$ = | a (fps) | 868.2 | 883.48 | 1141.85 | 888.19 | 1192.7 | |
| 3,960 | gamma (— | 1.2991 | 1.2991 | 1.2346 | 1.3302 | 1.3226 | |
| | flow (pps) | 35 | 35 | 35 | 35 | 35 | 0 |

Figure 19:
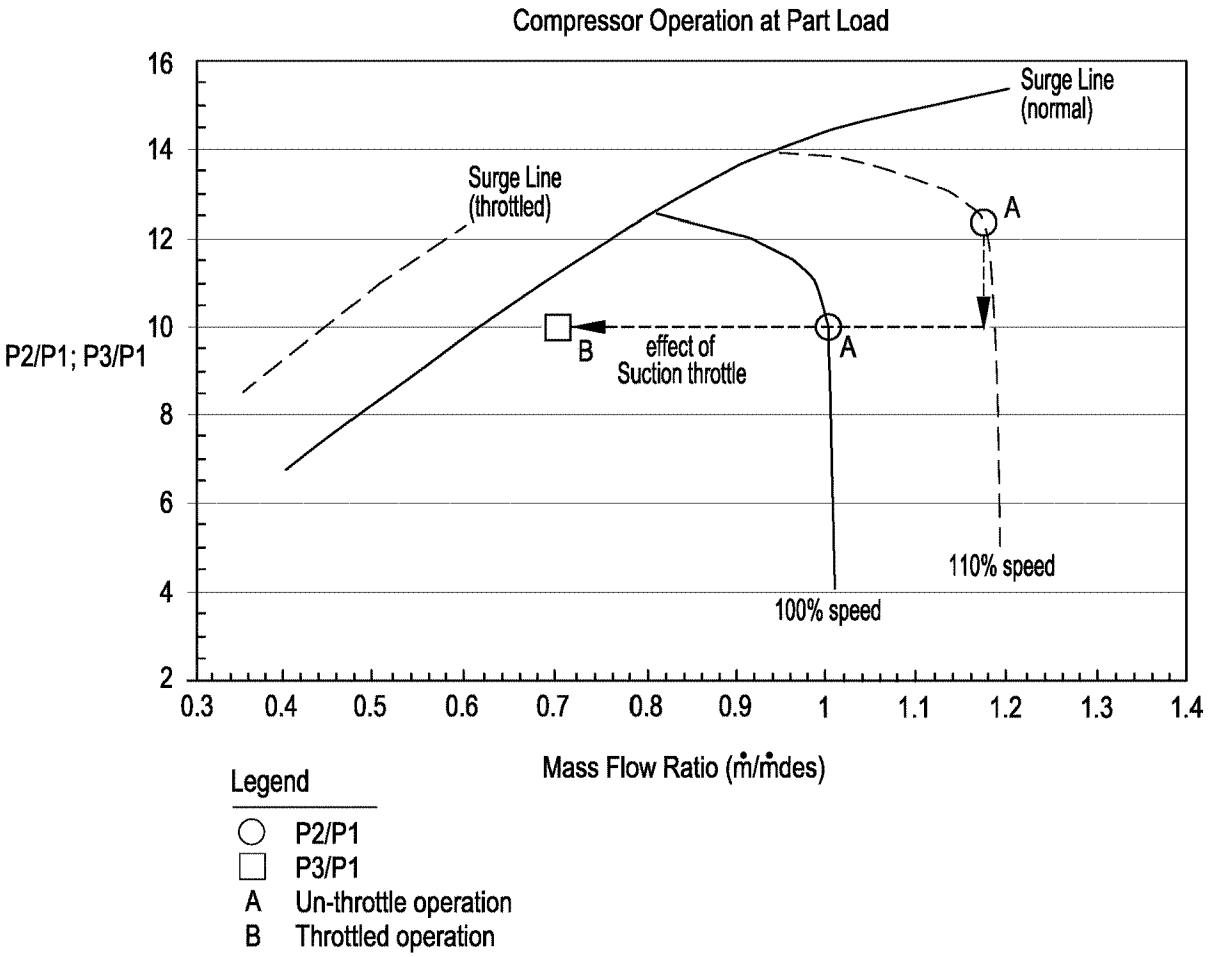
FIG. 19 is a compressor curve which shows the operation of a supersonic compressor at a full load design condition at a first rotary speed, and which shows the operation of the compressor at a part load condition wherein the rotary speed is higher than the full load design condition, and wherein efficiency degradation at part load operation is minimized.
Figure 19A:
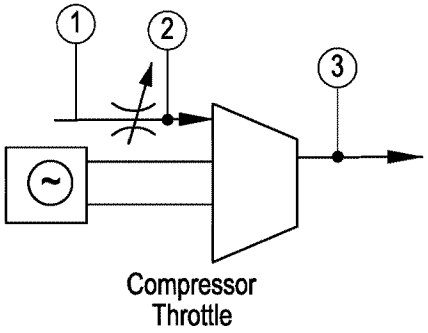
FIG. 19A is a diagrammatic representation of the use of a throttle valve on the incoming stream of a working fluid, to reduce the pressure, so that by increasing the rotor speed of a compressor, part load operation is provided with minimum loss in efficiency.

In various embodiments, a gearbox 206 may be configured with prime mover 210 such as an electric motor including adjustable speed drive. In an embodiment, the adjustable speed drive may be operably configured to drive a rotor assembly, which includes the first rotor and the second rotor, at varying rotating speeds. In an embodiment, the method of operation at varying rotating speeds include a nominal design speed, and a part load operating speed, and in which the part load operating speed is in excess of the nominal design speed. This technique allows increased operational efficiency at part load operation, as can be seen in FIG. 19, which describes part load and full load operating conditions. In an embodiment, the rotational speed at part load operation may be one hundred and ten percent (110%) of the nominal design full load rotating speed.

Utilizing the compressor design(s) taught herein, an efficient method of continuously compressing a gas may be achieved. In such embodiments, a gas compressor as set forth herein is provided. Gas to be compressed (reference point (1) in FIG. 18) is continuously provided to a LP low pressure inlet. The gas is continuously compressed in the LP compressor stage to provide a first compressed gas stream (reference point (2) in FIG. 18). The first compressed gas stream may be cooled in a low pressure heat exchanger 222 to provide cooled first compressed gas stream (reference point (4) in FIG. 18). The cooled first compressed gas stream is then continuously provided to a HP low pressure inlet. The HP compressor stage is operated to continuously compress the gas to provide a second compressed gas stream (reference point (5) in FIG. 18). The hot gas discharged from the HP compressor stage may be cooled using the HP heat exchanger 224, to provide a cooled second compressed gas stream that may be sent to a gas discharge location. This method of compression is particularly advantageous for compression of carbon dioxide.

Figure 20:
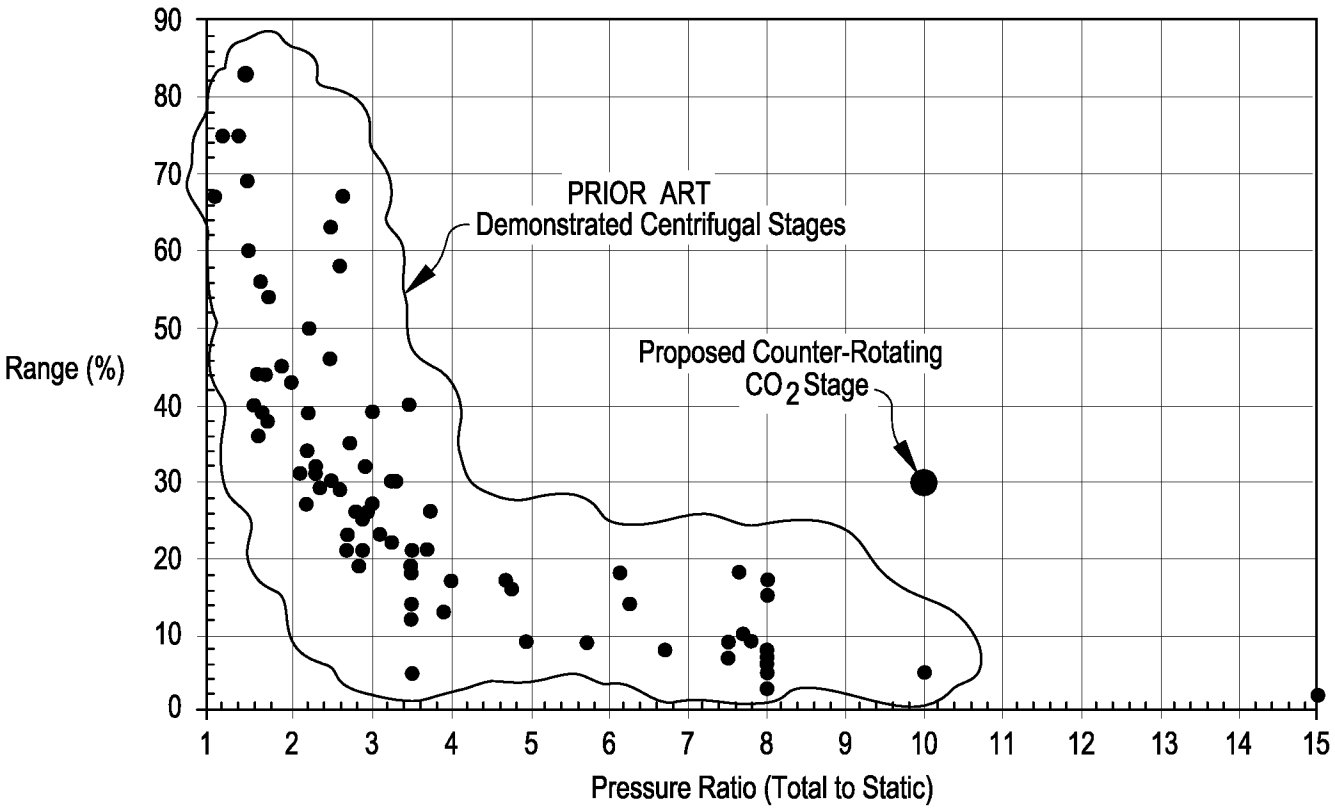
FIG. 20 is a plot of the pressure ratio (PR) versus the turndown range percent (%) for a range of prior art centrifugal compressors, as well as illustrating the improved pressure ratio and turndown range of a supersonic gas compressor using the design disclosed herein.
Figure 21:
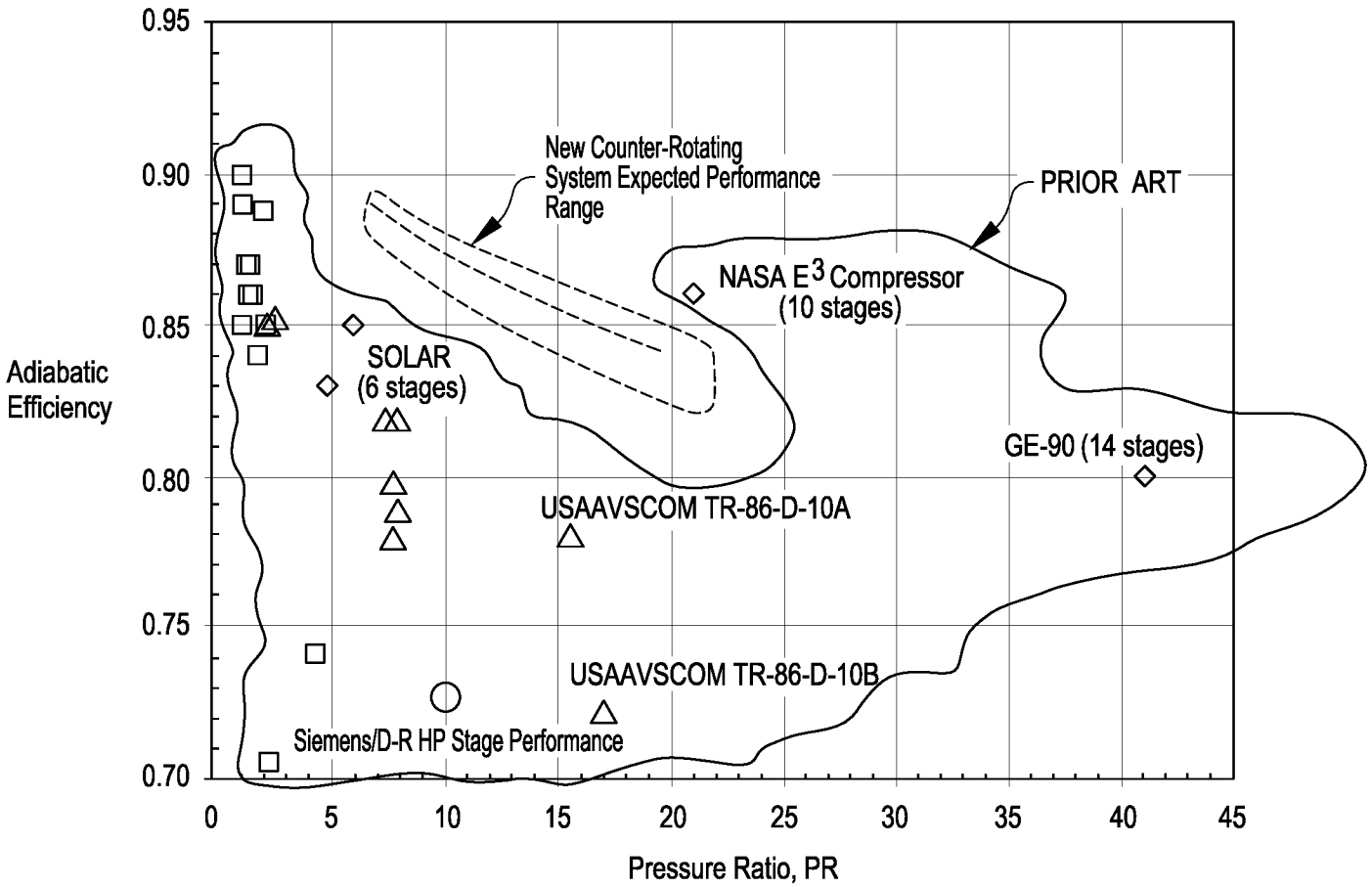
FIG. 21 is a plot of the adiabatic efficiency versus the pressure ratio (PR) for a range of prior art compressors, as well as illustrating the improved pressure ratio and efficiency of a supersonic gas compressor using the design disclosed herein.

The advantages provided by the compressor design(s) disclosed herein are readily apparent from FIG. 20 and from FIG. 21. FIG. 20 sets out a graph of a random selection of a range of demonstrated centrifugal compressor stage operating ranges ("Range (%)") plotted against their pressure ratios ("Pressure Ratio (Total to Static)"). This graph illustrates the practical design space of compressor turn down range percent at increasing pressure ratios. In most of these cases, the limitation on turndown at a particular stage pressure ratio has been imposed by rotor blade leading edge Mach number effects as discussed above. However, note that the counter rotating design(s) disclosed herein is projected to have up to a thirty percent 30% turndown, or perhaps slightly more, while operating at a pressure ratio of ten to one (10:1). This represents as substantial improvement in part load operation which is achievable by the counter-rotating design, using an adjustable position shockwave generating body as described herein.

FIG. 21 sets out the range of performance for the compressor design(s) disclosed herein, as compared to prior art compressor designs. Note the range map for the new counter-rotating system described herein. In an embodiment, a gas compressor 60 as described herein may be provided having an adiabatic efficiency in a range of between about zero point eight nine (0.89) at a pressure ratio of about six (6), and about zero point eight four (0.84) at a pressure ratio of about twenty (20).

The compressor design(s) provided herein are suitable, and would be advantageous, for a wide range of applications in the areas of power generation, flight propulsion, and general process gas compression. Moreover, the compressor design(s) disclosed herein are particularly well suited for an emerging application which has important implications in the area of carbon capture and sequestration (CCS) as may be more widely employed to address global climate change. In CCS, carbon dioxide ($CO_2$) gas is separated from a pollutant stream, or perhaps by direct removal from the atmosphere. The processes by which the $CO_2$ is separated are typically near atmospheric pressure (generally under about 5 bar (500 kPa)). The leading approach for storing or "sequestering" the $CO_2$, once it has been separated, involves transporting it in pipelines and then pumping it into impermeable "gas tight" subterranean chambers including depleted oil and natural gas wells.

For pipeline transportation and for subterranean injection, the $CO_2$ must be compressed to an elevated pressure (typically at least 100 bar (10000 kPa). Due to the relatively high molecular weight carbon dioxide, and low speed of sound in carbon dioxide, as summarized in Table 1, the compression of the $CO_2$ stream is a demanding and expensive process requiring multi-stage industrial process gas compressors. Based on studies performed by the US Department of Energy (DOE) and the National Energy Technology Laboratory (NETL), the cost of compressing the $CO_2$ stream would represent approximately 20% of the overall cost of the CCS process. Thus, when employed in a CCS application, the compressor disclosed and claimed herein would have the potential to significantly decrease the overall cost of CCS.

While my compressor would be advantageous if applied to a range of applications in many fields where the compression of a gas is required, for the purposes of introducing, illustrating and discussing the key features of the system, a design for a typical notional CCS application will be used as a reference case.

For understanding of the compressor design(s) disclosed above, as applied to carbon dioxide compression, consider a $CO_2$ gas compressor with a required overall compression pressure ratio of one hundred to one (100:1). As an example, a typical application might have a suction pressure of about fifteen pounds per square inch (15 psia), and a discharge pressure of about fifteen hundred pounds per square inch (1500 psia), with a design mass flow of rate of fifty pounds mass of carbon dioxide per second (50 lbm/s). For such an application, a two stage version of the exemplary supersonic compressor configuration, as shown in FIGS. 17 and 18, described above, would be useful. In such an application, each of the two stages is designed to achieve a compression ratio of about ten to one (10:1). In summary, the $CO_2$ gas would enter the first stage (Low pressure, LP Stage) at a pressure of about one atmosphere (about 1 bar (100 kPa)) and be discharged at a pressure of about ten bar (about 10 bar (1000 kPa)). In a typical embodiment, the gas stream would then be intercooled to remove some or all of the heat of compression and apply the heat to some useful secondary process, as noted in FIG. 18 above. Then the gas would flow into the second stage (High pressure, HP Stage) of the compressor at about ten bar (about 10 bar (1000 kPa)) and would be discharged from the second stage at a pressure of about one hundred bar (about 100 bar (10000 kPa)). As with the discharge from the first stage, in a typical embodiment, the discharge from the second stage may be aftercooled so that the heat of compression from the second stage could be removed for application in some other process as well. Removal and reapplication of the heat of compression from the two stages can have the effect of increasing the overall efficiency of the compression process.

Figure 22:
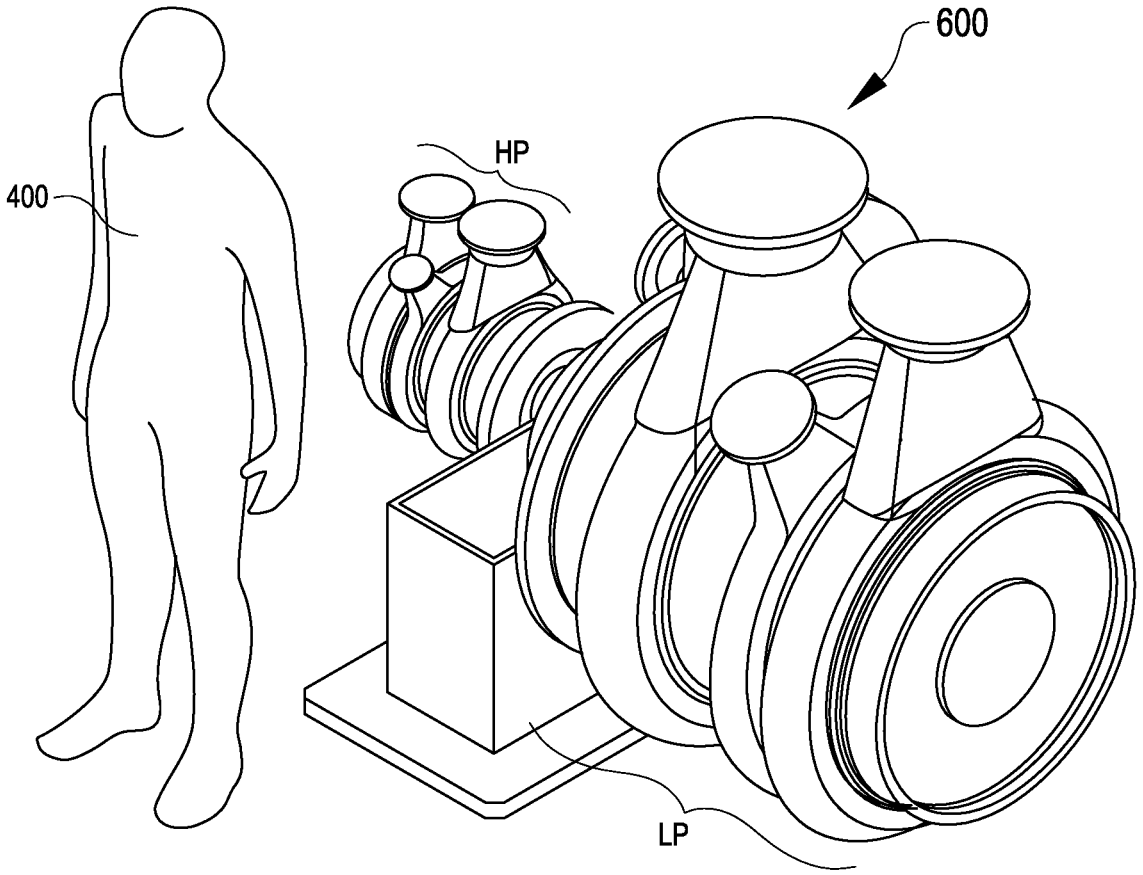
FIG. 22 a perspective of an embodiment for a two stage compressor system, wherein a low pressure (LP) first stage is provided, and a high pressure (HP) second stage is provided.

With respect to an exemplary compressor 60 design for compression of carbon dioxide, as just discussed above, see FIG. 22, where a perspective of an embodiment for a two stage compressor system 600, where a low pressure (LP) first stage is provided, and a high pressure (HP) second stage is provided. For the example just set out above, a size perspective is provided by a human size robot 400 standing next to compressor 600.

In one aspect, the design disclosed herein provides impulse blades 34 on the first rotor 30, where such blades do not achieve any significant increase in static pressure. Blades 34 are intended only to impart a tangential velocity component, or swirl, to the flow immediately upstream of the passageways 90 provided in the shock compression rotor 32. Because the impulse blades 34 impart virtually no static pressure rise, tip leakage is not a significant factor for such blades 34, and thus, such blades may be operated completely open or un-shrouded. However, the impulse blades may be advantageously operated at a relative Mach number is completely subsonic over the entire span of the blade (hub to tip) with a suggested maximum Mach number of about zero point eight five (0.85). Such a design range should avoid any complications in the aerodynamic starting of rotor 30 with impulse blades 34.

The novel provision of on-rotor (e.g. as noted above for second rotor 32) variable geometry control for the passageways 90 of the shock compression rotor 32 are a significant advance in the art of supersonic gas compression. To take advantage of such variable geometry functionality, the shape of the internals of passageways 90 are important to understand. The shape of each passageway 90 includes a series of largely planar surfaces on the side walls of the internal portion of the flowpath, as described in connection with FIG. 4 above, and may usually include the use of a diamond shaped body 110D in the middle of the flowpath, and thus functions as a centerbody. The internal surfaces are provided in a shape that results in a decrease in the internal flow area of the passageway 90, to a throat 102, and thus generate a series of oblique shock waves (see FIGS. 3, 13, and 14) in the working fluid once it enters the passageway 90.

The oblique shock waves (91, and $OS_2$, $OS_3$, and $OS_4$ in FIG. 13) progressively decelerate the working fluid which results in an increase in static pressure. Near the minimum flow area or throat 102 of the passageway 90, the Mach number of the flow has been reduced to about one point two to one point three (about 1.2 to 1.3) when the rotor is operating at the on-design point, as noted in FIG. 13. When operating at the design Mach number and with full compressor pressure ratio, a weak normal shock No is located just downstream of the throat 102. As a result of the normal shock No, the flow becomes subsonic with a Mach number of about zero point eight five (about 0.85). Once the flow is subsonic, the deceleration and pressure recovery in the flow continues but the subsonic flow requires an increase in flow area to accomplish this requirement.

A challenge in the operation of a supersonic shock compression system as just discussed arises when the system is being brought up to speed or "started". The amount of internal contraction that is required to efficiently decelerate the internal flow to a low pre-normal shock Mach number increases significantly as the inflow Mach number increases. As a result, a passage optimized for operation with in inflow Mach number of approximately two point three six (M ~2.36), would have too much contraction for operation at any inlet Mach number less than that Mach number. The result of such over contraction is that the inlets 901 to passageways 90 would not be able to pass all the mass flow that the inlet 901 would capture. As a consequence, the supersonic passageways 90 would remain in an "un-started" condition.

The present design overcomes this "startup problem" in two ways. First, the variable geometry provided by the movement of centerbody 110D allows for increased area for mass flow though the throat 102. Second, removal of a portion of the working fluid is provided by various bleed passageways, as described above. In summary, the exemplary shock compression rotor in the supersonic compressor design disclosed herein utilizes both bleed of mass flow, and variable throat 102 area to facilitate starting.

The ability to translate the centerbody 110D upstream and downstream while the shock compression rotor 32 is in operation provides the capability of varying the effective contraction ratio of the shock compression passageway 90 to respond to variations in passage inflow Mach numbers that could result from variations in rotor operating speed, inflow gas composition, temperatures or a range of other parameters that could have an effect on the passageway 90 inflow Mach number.

FIG. 11 details the region between the peripheral shroud 40 of the shock compression rotor 32 and the stationary compressor housing or pressure case 230. Details of the boundary layer bleed passages 182, 184, and 186 were discussed above. FIG. 4 shows the boundary layer bleed passageways 180 in and around the throat 102 area of the passageways 90. Boundary layer bleed gas is driven by elevated pressure into the individual bleed holes (180, 184, 186), and collected in passageways (190) in both the shock compression rotor 32 and centerbodies 110D, and then discharged from the outer surface of the rim of the shock compression rotor into a collector 240 formed between the outer rim of the shock compression second rotor 32 and the stationary compressor housing or pressure case 62. The collected bleed gas is further collected into an exterior plenum 190. This boundary layer bleed collector plenum 190 supplies the boundary layer bleed gas 188 to a return loop 242 which ultimately returns the gas 188 to the inflow of the gas compressor 60. This return loop 242 path is shown in the system process flow diagram shown in FIG. 18. During operation, a small amount (0.5%-2%) of the gas processed by the shock compression rotor, is bled off to stabilize the boundary layers in the region of the throat 203 of the passageways 90 and to prevent the flow of the process gas in passageways 90 from separating under the effects of the adverse pressure gradient in the passageways 90. However, during starting, as the shock compression rotor 32 and passageways 90 are being accelerated to operating speed, the boundary layer return circuit control valve may be opened completely, to allow (7%-15%) of the gas captured by the passageways 90 to be bypassed out of the flowpath prior to reaching the minimum cross-sectional area at the throat 102. Thus, boundary layer bleed/bypass is employed together with the variable area throat geometry discussed above to further facilitate the shock swallowing or starting process. The unique combination of mass removal (bleed) and variable, controllable supersonic passageway geometry provides significant advantages in efficient starting and operation compared to prior art supersonic compressors of which I am aware.

Additionally, suction (inlet) throttling combined with variable drive speed enables high efficiency while accommodating turndown on mass flow throughput. In this novel method of compressor operation, a throttle valve 220 is incorporated upstream of the compressor 60 low pressure inlet 66. This configuration is shown in the process flow diagram, set out in FIG. 18. When the mass flow to the compressor 60 is to be decreased, the throttle valve 220 is partially closed. This results in a decrease in the pressure and density of the gas downstream of the throttle valve 220. With fixed inflow passage geometry, this throttling results in a decrease in the mass flow processed by the compressor. And, the suppression of the suction pressure also results in a decrease in the discharge pressure.

In order to restore the discharge pressure to the nominal design discharge pressure, the rotary speed of the compressor is increased by increasing the rotary speed of first input shaft 74 (when one stage gas compressor 60 is utilized) and additionally the rotary speed of second input shaft 274 when a second stage 60HP is utilized. As an example, for the exemplary carbon dioxide compressor, at 30% turndown range, the combination of a 27% decrease in compressor inflow pressure (which is accomplished by the throttle valve 220 on the compressor inflow) and a 10% increase in compressor first input shaft 74 speed, can achieve the targeted 30% turndown level while maintaining compressor discharge pressure. Further, since the changes in angle of attack at the leading edges of the shock compression rotor vanes is relatively minor, the decrease in compressor efficiency may also be minor (i.e. achieving compressor adiabatic efficiency in the 85% to 86% range at 30% turndown). Many industrial compressors employ some form of a variable speed motor drive, or variable geometry devices, to accomplish the initial starting of a compressor. Consequently, the novel method just described, with minimal increase in system cost, is clearly superior to the prior art industry standard practice of employing relatively expensive variable position inlet guide vanes.

Moreover, the compressor system described herein is still able to accommodate the use of a hot gas bypass recycling technique, should starting process or operating scenarios be encountered that involve reduced mass flow levels below what can be accomplished with the inlet throttle operation just described above. In such cases, as seen in FIG. 18, a hot gas return line 300 may be included in the system. The fraction of system flow recirculated through this loop could be controlled by balancing flow control valves 302 on the system discharge and 304 on the recycle lines. With this approach, the mass flow of the compressor system could be reduced to near zero levels which would accommodate any practical operational requirements.

In the foregoing description, for purposes of explanation, numerous details have been set forth in order to provide a thorough understanding of the disclosed exemplary embodiments for the design of a supersonic compressor with an adjustable centerbody location. However, certain of the described details may not be required in order to provide useful embodiments, or to practice selected or other disclosed embodiments. Further, for descriptive purposes, various relative terms may be used. Terms that are relative only to a point of reference are not meant to be interpreted as absolute limitations, but are instead included in the foregoing description to facilitate understanding of the various aspects of the disclosed embodiments. And, various actions or activities in any method described herein may have been described as multiple discrete activities, in turn, in a manner that is most helpful in understanding the present invention. However, the order of description should not be construed as to imply that such activities are necessarily order dependent. In particular, certain operations may not necessarily need to be performed precisely in the order of presentation. And, in different embodiments of the invention, one or more structures may be simultaneously provided, or eliminated in part or in whole while other elements may be added. Also, the reader will note that the phrase "in an embodiment" or "in one embodiment" has been used repeatedly. This phrase generally does not refer to the same embodiment; however, it may. Finally, the terms "comprising", "having" and "including" should be considered synonymous, unless the context dictates otherwise.

It will be understood by persons skilled in the art that various elements useful for configurations of supersonic compressors for use with working fluids, and especially with heavy working fluids such as carbon dioxide, have been described herein only to an extent appropriate for such skilled persons to make and use such components in combination with supersonic compressor stages. Additional details may be worked out by those of skill in the art for a selected set of specifications, increased number of stages, compression ratio, useful life, materials of construction, and other design criteria, such as the overall efficiency when operating at either design conditions or at part load conditions.

Importantly, the aspects and embodiments described and claimed herein may be modified from those shown without materially departing from the novel teachings and advantages provided, and may be embodied in other specific forms without departing from the spirit or essential characteristics thereof. Therefore, the embodiments presented herein are to be considered in all respects as illustrative and not restrictive or limiting. As such, this disclosure is intended to cover the structures described herein and not only structural equivalents thereof, but also equivalent structures.

Although only certain specific embodiments of the present invention have been shown and described, the invention is not limited to such embodiments. Rather, the invention is to be defined by the appended claims and their equivalents when taken in combination with the description. Numerous modifications and variations are possible in light of the above teachings. Therefore, the protection afforded to this invention should be limited only by the claims set forth herein, and the legal equivalents thereof.

The invention claimed is:

1. A gas compressor, comprising:

(a) a pressure case, the pressure case comprising a peripheral wall;

(b) an inlet for supply of gas, and an outlet for compressed gas;

(c) a first drive shaft extending along a first central axis;

(d) a first rotor, the first rotor driven by the first drive shaft for rotary motion in a first direction within the pressure case, the first rotor comprising an outer surface portion, the first rotor further comprising blades, the blades each extending outward from the outer surface portion to a tip end, wherein the blades comprise impulse blades; and (e) a second rotor, the second rotor driven by the first drive shaft for rotary motion in a second direction within the pressure case, wherein the second direction is opposite in rotation from the first direction, the second rotor comprising (1) a fixed second rotor portion comprising a plurality of converging-diverging passageways configured for supersonic compression of gas, each of the plurality of converging-diverging passageways having an inlet with an initial shock wave generating surface, a throat portion having a variable cross-sectional area, and an exit, each of the plurality of converging-diverging passageways having a longitudinal axis, wherein the longitudinal axis is offset toward the first rotor by an angle of attack alpha ($\alpha$), (2) an adjustable second rotor portion, and (3) a geared interface between the fixed second rotor portion and the adjustable second rotor portion, wherein the adjustable second rotor portion further comprises shockwave generating bodies extending outward from the adjustable second rotor portion into converging-diverging passageways in the fixed second rotor portion, each shockwave generating body translatable using the geared interface to provide simultaneous axial and circumferential motion of the shockwave generating body relative to the first drive shaft, and wherein movement of a shockwave generating body along the longitudinal axis of a converging-diverging passageway in which it is located results in an increase or decrease in cross-sectional area of the throat portion, thereby enabling startup and supersonic gas compression operation of converging-diverging passageways.

2. A gas compressor as set forth in claim 1, wherein the converging-diverging passageways comprise a radially inward floor at radius R from the first central axis, and wherein the adjustable second rotor portion is adjustable with respect to the fixed second rotor portion by a circumferential angle theta ($\theta$), so that the shockwave generating body is translatable for an arc distance of length L.

3. A gas compressor as set forth in claim 2, wherein the adjustable second rotor portion is configured for axial movement away from the fixed second rotor portion by an axial distance X.

4. A gas compressor as set forth in claim 3, wherein each shockwave generating body is translatable upstream or downstream in a converging-diverging passageway in which it is located.

5. A gas compressor as set forth in claim 4, wherein each shockwave generating body is translatable in a helical path relative to the first central axis.

6. A gas compressor as set forth in claim 1, wherein the blades on the first rotor are unshrouded.

7. A gas compressor as set forth in claim 1, wherein each of the converging-diverging passageways further comprise a peripheral shroud.

8. A gas compressor as set forth in claim 7, wherein the peripheral shroud comprises a cylindrical annular ring, and wherein the cylindrical annular ring peripherally encompasses all of the converging-diverging passageways on the second rotor.

9. A gas compressor as set forth in claim 1, wherein the adjustable second rotor portion comprises an annular outer edge, and wherein each shockwave generating body is affixed to the annular outer edge.

10. A gas compressor as set forth in claim 1, wherein each shockwave generating body comprises a diamond shaped centerbody.

11. A gas compressor as set forth in claim 1, wherein each converging-diverging passageway is symmetrical along the longitudinal axis thereof.

12. A gas compressor as set forth in claim 1, wherein the geared interface comprises a first hub bore in the adjustable second rotor portion, the first hub bore having an interior surface comprising a plurality of first helical grooves sized and shaped for receiving ball bearings of complementary size and shape therein.

13. A gas compressor as set forth in claim 12, wherein the geared interface comprises a second hub bore in the fixed second rotor portion, and extending therefrom, a nipple portion having an external surface, the external surface comprising a plurality of second helical grooves sized and shaped for receiving ball bearings of complementary size and shape therein.

14. A gas compressor as set forth in claim 13, further comprising a plurality of ball bearings, the plurality of ball bearings located between first helical grooves in the first hub bore and second helical grooves in the nipple portion of the fixed second rotor portion, the ball bearings sized and shaped for adjustable engagement between the fixed second rotor portion and the adjustable second rotor portion, wherein the adjustable engagement provides for helical movement of the adjustable second rotor portion relative to the fixed second rotor portion, wherein during movement of a shockwave generating body, it remains disposed along the longitudinal axis of the converging-diverging passageway in which it is located.

15. A gas compressor as set forth in claim 14, wherein the ball bearings are sized to provide tight fitment and contact between the ball bearings and (a) first helical grooves, and (b) second helical grooves, thereby allowing precision adjustment between the fixed second rotor portion and the adjustable second rotor portion.

16. A gas compressor as set forth in claim 15, wherein a helical angle delta (Δ) of first helical grooves and a helical angle sigma (σ) of second helical grooves are each selected so that circumferential and axial movement of the adjustable second rotor portion with respect to the fixed second rotor portion results in movement of a shockwave generating body along the longitudinal axis of a converging-diverging passageway in which it is located.

17. A gas compressor as set forth in claim 15, further comprising an oil gallery, the oil gallery defined between and by an external passageway sidewall in the hub of the adjustable second rotor portion, and an internal passageway having an end closure defined by a nipple portion of the fixed second rotor portion, the oil gallery configured for receiving and containing therein oil for urging the adjustable second rotor portion axially away from the end closure of the internal passageway of the fixed second rotor portion.

18. A gas compressor as set forth in claim 17, further comprising a compression spring, the compression spring configured to urge the adjustable second rotor portion axially away from the fixed second rotor portion when pressure of oil in the oil gallery is insufficient to urge the adjustable second rotor portion toward the fixed second rotor portion.

19. A gas compressor as set forth in claim 1, wherein the geared interface comprises a plurality of first ball bearing receiving channels in a hub bore in the adjustable second rotor portion, the plurality of first ball bearing receiving channels comprising a plurality of helical grooves sized and shaped for receiving ball bearings of complementary size and shape therein.

20. A gas compressor as set forth in claim 19, wherein the geared interface further comprises a second hub bore in the fixed second rotor portion, and extending therefrom, a nipple portion having an external surface, the external surface comprising a plurality of second ball bearing receiving channels sized and shaped for receiving ball bearings of complementary size and shape therein.

21. A gas compressor as set forth in claim 20, further comprising a plurality of ball bearings, the plurality of ball bearings located between first ball bearing receiving channels and second ball bearing receiving channels, the plurality of ball bearings sized and shaped for adjustable engagement with first ball bearing receiving channels and with second ball bearing receiving channels during movement between the fixed second rotor portion and the adjustable second rotor portion, wherein the adjustable engagement provides for helical movement of the adjustable second rotor portion relative to the fixed second rotor portion, wherein each shockwave generating body moves axially and arcuately, while remaining disposed along the longitudinal axis of the converging-diverging passageway in which it is located.

22. A gas compressor as set forth in claim 21, wherein the ball bearings are sized so as to provide tight fitment and constant contact between the ball bearings and first helical grooves, and between the ball bearings and second helical grooves, thereby allowing precision adjustment.

23. A gas compressor as set forth in claim 1, wherein the geared interface comprises one or more of (a) helical grooves and ball bearings, (b) a helical spline; (c) a worm gear; and (d) a guide slot with cam follower.

24. A gas compressor as set forth in claim 1, wherein converging-diverging passageways comprise a radially inward floor, and wherein converging-diverging passageways further comprise boundary layer bleed passageways, and wherein at least some boundary layer bleed passageways are located in the radially inward floor at or adjacent the throat portion.

25. A gas compressor as set forth in claim 24, wherein boundary layer bleed passages comprise a plurality of holes in the radially inward floor.

26. A gas compressor as set forth in claim 24, further comprising boundary layer bleed passageways in a shockwave generating body.

27. A gas compressor as set forth in claim 24, wherein boundary layer bleed passageways within a converging-diverging passageways corresponds to a longitudinal location along a flowpath of gas therein where a normal shock occurs during supersonic operation.

28. A gas compressor as set forth in claim 24, further comprising a bleed outlet fluidly connected to boundary layer bleed passageways.

29. A gas compressor as set forth in claim 28, wherein the bleed outlet is sized and shaped to enable removal of between about seven percent (7.0%) and fifteen percent (15.0%) of gas entering each converging-diverging passageway during startup of the gas compressor.

30. A gas compressor as set forth in claim 28, wherein the bleed outlet is sized and shaped to enable removal of between about one-half of one percent (0.5%) and two percent (2.0%) of gas entering each converging-diverging passageway during normal operation.

31. A gas compressor as set forth in claim 1, wherein the shockwave generating body is translatable to a downstream position during startup of compressor operation.

32. A gas compressor as set forth in claim 1, wherein the shockwave generating body is translatable to an upstream position during supersonic compressor operation.

33. A gas compressor as set forth in claim 1, wherein the shockwave generating body is adjustably translatable to an optimum operating efficiency position during operation, and wherein the optimum operating efficiency position is between an upstream limit position and a downstream limit position.

34. A gas compressor as set forth in claim 31, or in claim 32, or in claim 33, wherein the shockwave generating body comprises a diamond shaped centerbody.

35. A gas compressor as set forth in claim 1, wherein the pressure case comprises structure adapted to contain a working fluid therein at an operating pressure of up to one hundred fifty (150) bar.

36. A gas compressor as set forth in claim 1, wherein the pressure case comprises structure adapted to contain a working fluid therein while operating at a pressure ratio of between about six (6) and about twenty (20).

37. A gas compressor as set forth in claim 1, wherein adiabatic efficiency of the gas compressor ranges between about zero point eight nine (0.89) at a pressure ratio of about six (6), and about zero point eight four (0.84) at a pressure ratio of about twenty (20).

38. A gas compressor system, comprising:

(a) a pressure case, the pressure case comprising a low pressure inlet and a high pressure outlet;

(b) a first drive shaft extending along a first central axis;

(c) a first rotor, the first rotor rotatably driven by the first drive shaft, the first rotor comprising a plurality of impulse blades configured for subsonic operation, the first rotor configured to receive gas from the low pressure inlet and accelerate the gas in a first direction of rotation;

(d) a second rotor, the second rotor driven by the first drive shaft for rotary motion in a second direction within the pressure case, the second rotor comprising (1) a fixed second rotor portion comprising plurality of converging-diverging passageways configured for supersonic compression of gas, each converging-diverging passageway having an inlet with an initial shock wave generating surface, a throat portion having a variable cross-sectional area, and an exit, each converging-diverging passageway having a longitudinal axis, wherein the longitudinal axis is offset toward the first rotor by an angle of attack alpha ($\alpha$), (2) an adjustable second rotor portion, (3) a geared interface between the fixed second rotor portion and the adjustable second rotor portion, and (4) wherein the adjustable second rotor portion comprises shockwave generating bodies extending outward from the adjustable second rotor portion into each of the converging-diverging passageways, each shockwave generating body translatable upstream or downstream along the longitudinal axis of the converging-diverging passageway in which it is located by simultaneous circumferential and axial adjustment of the adjustable second rotor portion with respect to the fixed second rotor portion, and wherein upstream or downstream movement of a shockwave generating body along the longitudinal axis of a converging-diverging passageway in which it is located results in an increase or decrease in cross-sectional area of the throat portion, thereby enabling startup and supersonic operation of converging-diverging passageways over a range of inflow Mach numbers;

(e) wherein the gas compressor system comprises a two rotor per stage compressor system, and wherein the first rotor and the second rotor are juxtaposed in a counter-rotating configuration; and (f) further comprising a gearbox and an adjustable speed drive, the adjustable speed drive operably configured to drive the first rotor and the second rotor at varying rotating speeds.

39. The gas compressor system as set forth in claim 38, wherein the varying rotating speeds include a nominal design rotating speed, and a part load rotating speed, wherein the part load rotating speed is in excess of the nominal design rotating speed.

40. A gas compressor system, comprising:

(a) an LP pressure case, the LP pressure case comprising a LP low pressure inlet and a LP high pressure outlet;

(b) a first drive shaft extending along a first central axis and into the LP pressure case;

(c) a HP pressure case, the HP pressure case comprising a HP low pressure inlet and a HP high pressure outlet;

(d) a second drive shaft extending along a second central axis and into the HP pressure case;

(e) a LP compressor stage, the LP compressor stage comprising (1) a first rotor, the first rotor rotatably driven by the first drive shaft, the first rotor comprising a plurality of impulse blades configured for subsonic operation, the first rotor configured to receive gas from the LP low pressure inlet and accelerate the gas in a first direction of rotation;

(2) a second rotor, the second rotor driven by the first drive shaft for rotary motion in a second direction within the LP pressure case, the second rotor comprising (i) a fixed second rotor portion comprising plurality of converging-diverging passageways configured for supersonic compression of gas, each converging-diverging passageway having an inlet with an initial shock wave generating surface, a throat portion having a variable cross-sectional area, and an exit, each converging-diverging passageway having a longitudinal axis, wherein the longitudinal axis is offset toward the first rotor by an angle of attack alpha ($\alpha$), (ii) an adjustable second rotor portion, and (iii) a geared interface between the fixed second rotor portion and the adjustable second rotor portion, wherein the adjustable second rotor portion further comprises shockwave generating bodies extending outward from the adjustable second rotor portion into each converging-diverging passageway, each shockwave generating body translatable upstream or downstream along the longitudinal axis of a converging-diverging passageway in which a shockwave generating body is located by simultaneous circumferential and axial adjustment of the adjustable second rotor portion with respect to the fixed second rotor portion, and wherein upstream or downstream movement of each shockwave generating body along the longitudinal axis of a converging-diverging passageway in which it is located allows an increase or decrease in cross-sectional area of the throat portion, thereby enabling startup and supersonic operation of the converging-diverging passageway over a range of inflow Mach numbers;

(3) wherein the LP compressor stage comprises a two rotor compressor system, and wherein the first rotor and the second rotor are juxtaposed in a counter-rotating configuration; and (f) a HP compressor stage, the HP compressor stage comprising:

(1) a first rotor, the first rotor rotatably driven by the second drive shaft, the first rotor comprising a plurality of impulse blades configured for subsonic operation, the first rotor configured to receive gas from the HP low pressure inlet and accelerate the gas in a first direction of rotation;

(2) a second rotor, the second rotor driven by the second drive shaft for rotary motion in a second direction within the HP pressure case, the second rotor comprising (i) a fixed second rotor portion comprising plurality of converging-diverging passageways configured for supersonic compression of gas, each converging-diverging passageway having an inlet with an initial shock wave generating surface, a throat portion having a variable cross-sectional area, and an exit, each converging-diverging passageway having a longitudinal axis, wherein the longitudinal axis is offset toward the first rotor by an angle of attack alpha ($\alpha$), (ii) an adjustable second rotor portion, and (iii) a geared interface between the fixed second rotor portion and the adjustable second rotor portion, wherein the adjustable second rotor portion further comprises shockwave generating bodies extending outward from the adjustable second rotor portion into each converging-diverging passageway, each shockwave generating body translatable upstream or downstream along the longitudinal axis of a converging-diverging passageway in which the shockwave generating body is located by simultaneous circumferential and axial adjustment of the adjustable second rotor portion with respect to the fixed second rotor portion, and wherein upstream or downstream movement of each shockwave generating body along the longitudinal axis of a converging-diverging passageway in which it is located allows an increase or decrease in cross-sectional area of the throat portion, thereby enabling startup and supersonic operation of the converging-diverging passageway over a range of inflow Mach numbers; and (3) wherein the HP compressor stage comprises a two stage compressor system, and wherein the first rotor and the second rotor of the HP compressor stage are juxtaposed in a counter-rotating configuration.

41. A gas compressor system as set forth in claim 40, further comprising a gearbox and an adjustable speed drive, the adjustable speed drive operably configured to vary rotational speed of a rotor assembly, wherein the rotor assembly comprises the first rotor and the second rotor.

42. A gas compressor system as set forth in claim 40, wherein rotational speed of a rotor assembly includes a nominal design rotating speed and a part load operation rotating speed, and wherein the part load operation rotating speed is in excess of the nominal design rotating speed.

43. A method of continuously compressing a gas, comprising:

providing a gas compressor system as set forth in claim 40;

continuously providing a gas to the LP low pressure inlet;

continuously compressing the gas in the LP compressor stage to provide a first compressed gas stream;

cooling the first compressed gas stream to provide a cooled first compressed gas stream;

continuously providing the cooled first compressed gas stream to a HP low pressure inlet; and continuously compressing the gas in the HP compressor stage to provide a second compressed gas stream.

44. The method as set forth in claim 43, further comprising cooling the second compressed gas stream to provide a cooled second compressed gas stream.

45. The method as set forth in claim 43, wherein the gas comprises carbon dioxide.

46. The method as set forth in claim 43, wherein the gas compressor comprises a gearbox and an adjustable speed drive, wherein the adjustable speed drive is operably configured to drive the first rotor and the second rotor of the LP compressor stage and the first rotor and the second rotor of the HP compressor stage at varying rotating speeds, and wherein the varying rotating speeds include a nominal design rotating speed, and a part load operation rotating speed, wherein the part load operation rotating speed is in excess of the nominal design rotating speed, and wherein the method further comprises operating the gas compressor at a gas throughput part load condition at a design rotating speed in excess of the nominal design rotating speed.

* * * * *